US006131867A

United States Patent [19]

Mallek

[11] Patent Number: 6,131,867

[45] Date of Patent: Oct. 17, 2000

[54] CUSTOM MOUNT FOR WINDOW DRESSING

[76] Inventor: Paul P. Mallek, 430 Sawgrass Ct., Westminster, Md. 21158

[21] Appl. No.: 08/896,837

[22] Filed: Jul. 18, 1997

Related U.S. Application Data

[63] Continuation-in-part of application No. 08/736,721, Oct. 25, 1996, Pat. No. 5,865,562.

[51] Int. Cl.[7] ..... A47H 1/10

[52] U.S. Cl. ..... 248/261; 248/262

[58] Field of Search ..... 248/251, 261, 248/262, 201, 208

[56] References Cited

U.S. PATENT DOCUMENTS

| | | | |
|---|---|---|---|
| 786,468 | 4/1905 | Spencer | 248/262 X |
| 1,057,043 | 3/1913 | Dohm | 248/262 |
| 2,230,948 | 2/1941 | Heisey . | |
| 2,747,218 | 5/1956 | McMurray | 248/262 X |
| 2,770,437 | 11/1956 | Pasch . | |
| 2,911,175 | 11/1959 | Erie . | |
| 2,913,212 | 11/1959 | Bell | 248/262 |
| 3,112,912 | 12/1963 | Alvarez . | |
| 3,614,045 | 10/1971 | Ceglelski, Jr. . | |
| 4,964,604 | 10/1990 | Lombard . | |
| 5,042,553 | 8/1991 | Schaffer et al. | 248/251 X |
| 5,060,710 | 10/1991 | Haarer | 248/262 X |
| 5,193,775 | 3/1993 | Wagnon . | |
| 5,230,493 | 7/1993 | Luoto | 248/251 |
| 5,353,857 | 10/1994 | Anderson | 248/251 X |
| 5,398,900 | 3/1995 | Schober | 248/251 |

FOREIGN PATENT DOCUMENTS

WO 91/02135 2/1991 WIPO .

*Primary Examiner*—Terry Lee Melius
*Assistant Examiner*—William L. Miller
*Attorney, Agent, or Firm*—Donald C. Casey

[57] ABSTRACT

A device for mounting a wide variety of different window dressings is described. The device is intended to use conventional mounting brackets to mount the window dressing without the necessity of providing holes to mount the same in the face of the window molding or frame. The device includes either a corner or linear mounting plate which, respectively, may be used either on the right hand or left hand corner, or horizontally or vertically on the frame. Each plate is U-shaped in cross-section and intended to cover the sides and front of the window frame or molding or L-shaped to cover a portion. In one embodiment the portion covering the face can be laterally adjustable. Another embodiment provides flanges for mounting directly on the wall surrounding the window when no molding is present. The front face of the plate may be provided with a plurality of mutually spaced dimensioned cut-outs. A universal clip which is a channel shaped member having integral projections extending from the back surface thereof may also provided. The projections are also mutually spaced and dimensioned to register on the cut-outs in the mounting plate and to be received therein to secure the clip to the mounting plate. The clip in turn receives a conventional bracket or an interface plate which is a track like member attached to either a shutter, or a conventional type bracket wherein the interface plate itself is slidably received in the clip. An alternate embodiment shows a projection extending outwardly from a mounting bracket on the molding to receive the foot of a tension rod. The bracket can cover an inside or outside portion of the molding and be mounted on the molding by one or more tacks. Another embodiment mounts a box for the ends of a mini-blind and slots or holes can be provided for axial pins of rollers for shades.

14 Claims, 36 Drawing Sheets

CUSTOM MOUNT FOR WINDOW DRESSING

CROSS-REFERENCE TO RELATED APPLICATIONS

This patent application is continuation-in-part of my application Ser. No. 08/736,721, filed Oct. 25, 1996, now U.S. Pat. No. 5,865,562.

FIELD OF THE INVENTION

This invention relates to a mounting device for window dressings such as shades, blinds, curtains, drapes, swag, shutters and the like. The device of this invention is adaptable to fit and to be mounted on a variety of different types of moldings or window frames, and when mounted on a frame, provides for rapid attachment of a window dressing thereto.

DESCRIPTION OF THE PRIOR ART

Conventionally, each different type of window dressing requires its own special purpose mounting bracket or set of mounting brackets and also requires typically that the brackets themselves be secured to the window molding with nails or screws and placed at precise locations because the brackets, themselves, can not be adjusted after mounting. Therefore, mounting, for example, a venetian blind, set of shutters, or the like can be a difficult job even for skilled craftsman. Furthermore, because the brackets must be placed precisely the measurement must be precise and mistakes can cause unsightly pre-drilled mounting holes which in turn must be filled, and painted.

In older homes, the window sizes usually are not standard. In addition, different types of molding may surround the window frame and the molding may not be of uniform dimensions. If an exterior mounting is desired, on the face of the molding, the mounting brackets must be precisely placed and holes drilled into the molding face. If it later is desired to change the type of widow dressing, the new brackets may leave holes uncovered, presenting an unsightly problem for the decorator. In addition, such moldings are typically of hard wood and therefore difficult to drill by hand.

In the case of newer homes with standard size windows, the window dressing often times must be mounted on a minimal molding or frame. While the window dressing itself may be purchased to conform to standard window dimensions, the problem of attaching dressing to the molding quickly and efficiently remains.

The above difficulties have been known in the prior art but addressed with only marginal success. For example, in U.S. Pat. No. 2,230,948, brackets are provided which are intended to be mounted on the face of a molding with nails or screws, and have a pair of pins struck therefrom or mounted thereon which in turn support a curtain rod of conventional design. In this situation, it is necessary to drill holes directly into the face of the molding and the brackets must be mounted at precise distances from each other to accommodate the curtain rod. In U.S. Pat. No. 2,911,175, a corner bracket is provided with an integral curtain rod support which extends from a front face thereof. This bracket is secured to the window frame by screws in the face and sides of the molding. Similar attachment brackets are shown in U.S. Pat. Nos. 2,770,437, and 4,964,604.

In U.S. Pat. No. 5,193,775, brackets are provided which can be mounted on the corners or on a flat surface of a window frame and each of said brackets have hooks struck therefrom which are intended to mount support hardware for window dressings. The brackets, however, are mounted in the side of the molding only and therefore can not be used to accommodate certain types of conventional window dressings.

Other types of brackets are shown in U.S. Pat. Nos. 3,614,045, and 3,112,912.

In these prior art patents, the brackets described are not universally adaptable to different window dressings, or must be mounted in a specific, non-adjustable fashion on the window frame or molding so that they either require holes in the face of the molding, or precise locations on the molding so that the window dressing can be accommodated.

There is not then known in the prior art a universally adaptable mounting device for window dressings which can accommodate a variety of conventional window dressings, is readily adjustable to accommodate different widths, and does not require defacing the window frame or molding in order to be mounted thereon.

SUMMARY OF THE INVENTION

It is has been discovered that a universal mounting device for window dressings of conventional design which can adapt these window dressings to a variety of different types of windows can be designed according to this invention. The device of this invention incorporates a basic mounting plate, one or more universal clip member adjustably attachable to the plate, and which then retains single or multiple conventional mounting brackets for the window dressings or a third member which is an interface plate useful for mounting shutters or any applicable dressing or hardware requiring screw or bolt fasteners. In all instances according to the device of this invention provides ready adjustment without substantial construction, and without mounting holes in the front face of the molding or window frame.

The device can also be used to combine different dressings on a pair of mounting plates, for example.

A preferred embodiment mounting plate of this invention has two basic forms, a corner base plate, and a linear base plate. The corner plate will accommodate either corner of the window frame or molding and the linear plate is adaptable to either horizontal or vertical placement thereon. In both instances the mounting plates are secured by, for example, thumb tacks into the side of the molding and the mounting plates all are provided with a plurality of mutually spaced and sized symmetrical cut-outs on faces thereof.

The second element of the device of this invention is a universal clip which is a generally channel-shaped member having sides forming tracks in the forward face and mounting mutually spaced integral insert members on the inner face. The insert members are dimensioned to be received in the corresponding cut-outs in either base plate so that when inserted, they will secure the clip member to the base plate which in turn is secured to the molding or window frame. The clip member then receives in its track a conventional bracket of the type typically secured directly to the window frame or molding by screws in to the face thereof.

In the case of shutters or other screw fastened mountings an interface plate, the third element of this invention, can be used. In this instances the interface plate must be secured by screws or the like to the inside of the shutter. The plate, however, has opposed ridges which are received in the clip so that the shutter can be quickly mounted on the clip which in turn is mounted to the base plate, which in turn is secured to the window frame or molding. While the placement of the interface plate on the back face of the shutter vertical frame member requires the use of screws and somewhat precise location, the lateral location of the shutter mounted on the base plate of this invention is fully adjustable by movement of the universal clip relative to the base plate. A stop is also provided on each universal clip so that the shutter member with the interface plates thereon can be slid downwardly thereinto and retained by the stop.

In another embodiment of this invention a retaining lip is provided on the mounting bracket so that when installed vertically, a tension rod may be retained between a pair of opposed such mounting plates. In addition, a U-shaped bracket or hook can be mounted on the internal edge of a linear base plate to retain the mid portion of, for example, an interiorally mounted mini-blind or such a hook can be mounted in conventional fashion in the universal clip on a horizontally disposed linear base plate to provide a mid-run support for a curtain rod. In addition, in one embodiment of this invention, a corner projection is provided on the corner base plates extending from the edge thereof and defining a hole perpendicular to the face of said mounting plate. Such hole can mount the post of a swag hanger or serve as a guide hole or as an anchor hole if the post is snugly retained in the hole.

Accordingly it is an object of this invention to provide a universally adaptable mounting bracket which will fit a variety of different types of window frames and which will support conventional mounting brackets for a wide variety of different window dressings.

It is another object of this invention to provide corner and linear base plates which are secured to the sides of a window frame or molding which in turn adjustably support clip members which in turn mount conventional brackets for supporting window dressing so that the clip members can be adjusted vertically or horizontally without moving the fixed base plates.

It is another object of this invention to provide a universally adaptable mounting bracket which includes a base plate secured to the side of a window frame or molding, a universal clip which may be quickly and easily mounted to the base plate, and an interface plate which when secured to a shutter or other window dressing of similar design can be slideably received in the clip to mount the same on the window frame.

It is yet another object of this invention to provide a universally adjustable clip member which is securely mounted to the base plate of a mounting device for window dressing by providing integral shaped male members extending from the back of the universal clip and a plurality of mutually spaced shaped holes, each adaptable to receive one of said members and to secure the same therein against movement of the supporting clip member relative to the base plate.

These and other objects will become readily apparent with reference to the drawings and following description wherein:

DETAIL DESCRIPTION OF THE INVENTION

Figure 1:
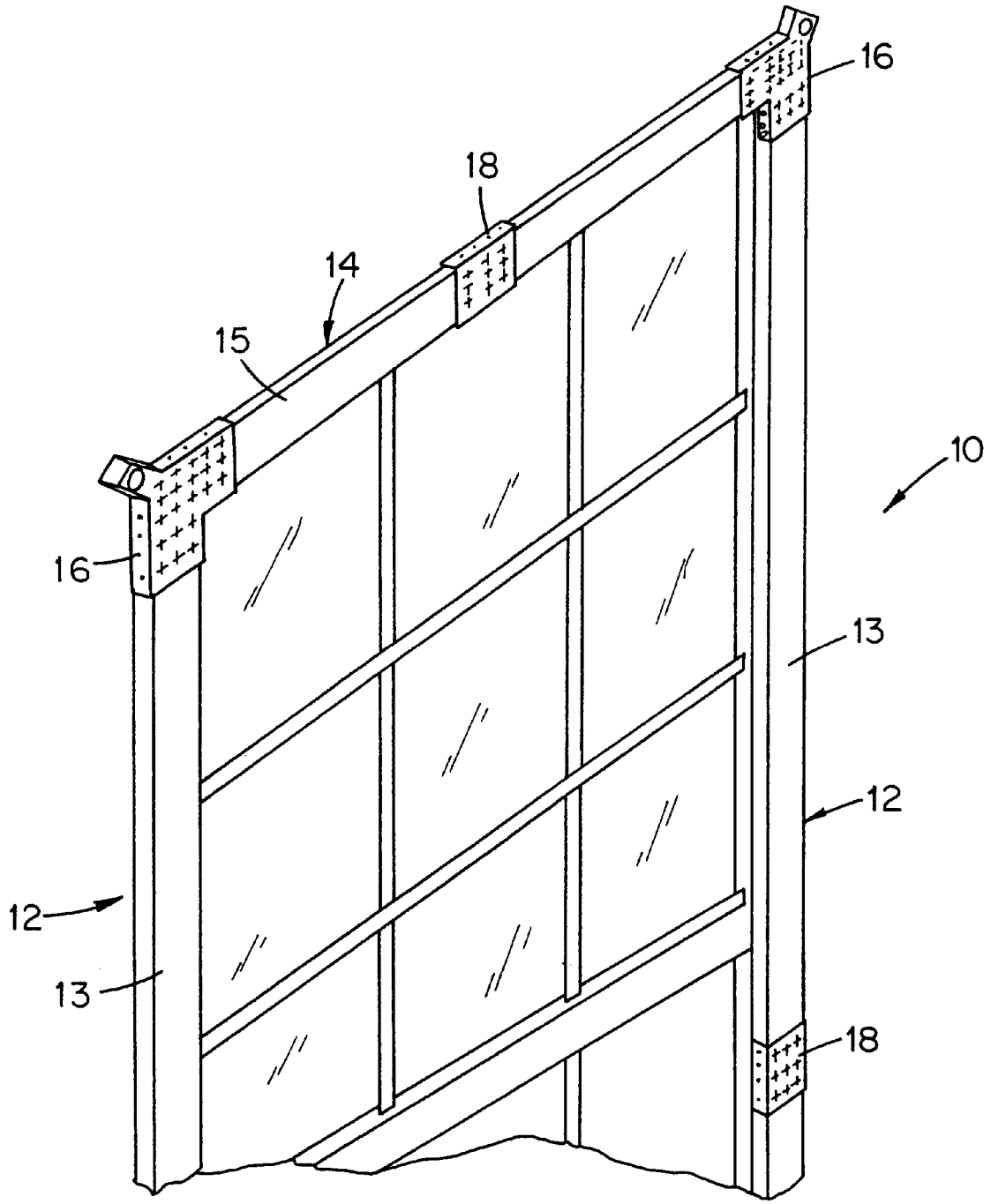
FIG. 1 is a fragmentary view illustrating mounting of a linear and corner mounting base plates of the device of this invention on a window frame.
Figure 2:
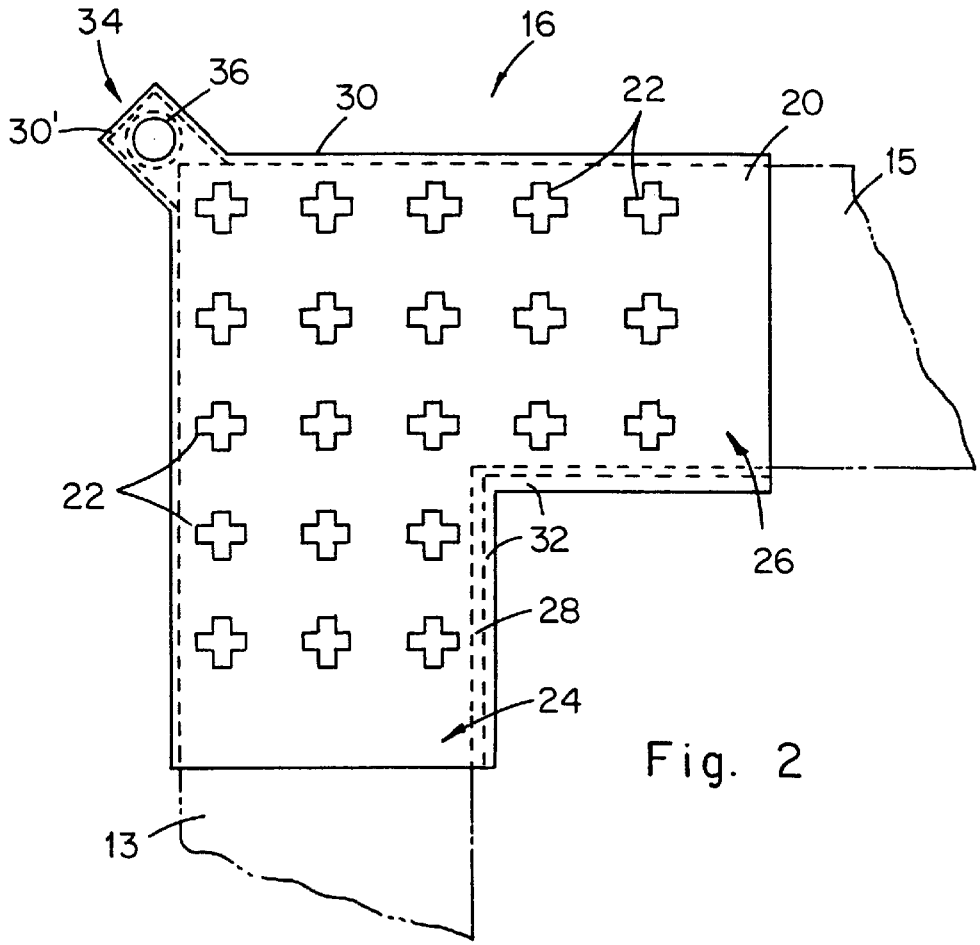
FIG. 2 is a front view of an embodiment of the left hand corner mounting plate of this invention.

With attention to the drawings and FIG. 1 in particular, there is shown a window 10 having a frame or molding consisting of vertical sides 12 and a horizontal top 14. The horizontal bottom is not shown. Corner mounting plates 16 according to this invention are provided at the right and left corners and as will be obvious to those skilled in the art corner plates 16 are interchangeable between the right hand and left hand corners. A single corner plate then can be adapted to either corner, and as will be subsequently explained, can be adapted to a wide variety of different type of frames 12.

There is also shown linear mounting plates 18 which are dimensioned to fit either vertically on sides 12, or horizontally on side 14.

As will be subsequently explained, the frame 12 shown in FIG. 1 consists of members 12 and 14 which are rectangular in cross-section and present a smooth outer face, 13, or 15, respectively. The mounting device of this invention is equally suited to a molding having a decorative outer face in place of the smooth face shown.

With attention to FIGS. 2–5, the corner mounting plate 16 has an outer or forward looking face 20 which is provided with a plurality of mutually spaced cut-outs 22 which are disposed across the surface of the outer face 20.

Figure 3:
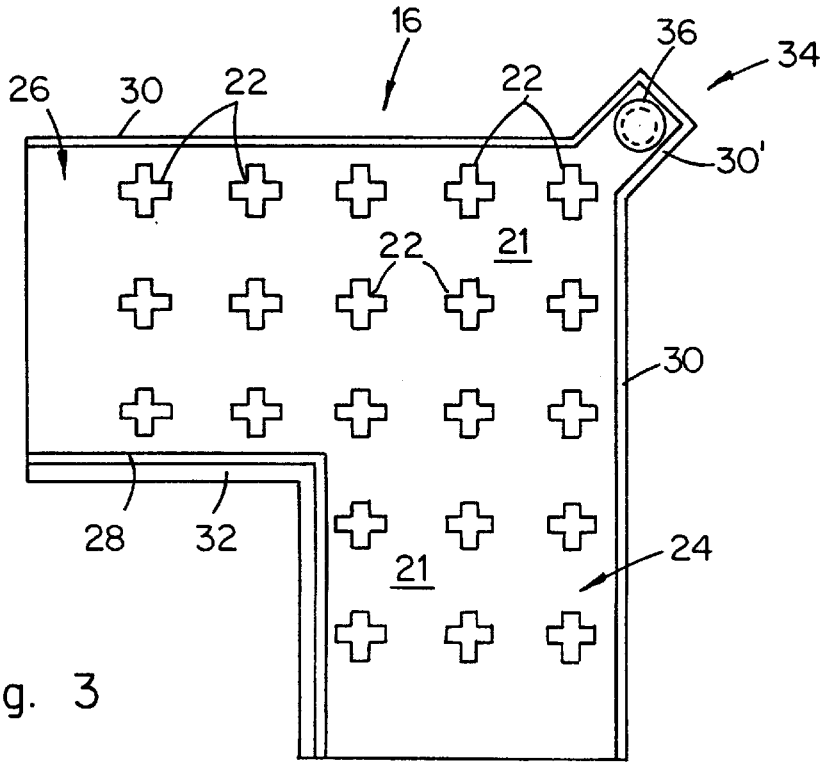
FIG. 3 is a rear view of the mounting plate of FIG. 2.

FIG. 3 is a rear view of the corner bracket 16 showing the inner surface 21 of the outer face 20 and the cruciform type cut-outs 22 which are mutually spaced thereacross.

In addition, the corner mounting plate 16 consists of a pair of integral legs 24 and 26 which are disposed at right angles to each other and an inner side member 28 and an outer side member 30.

In addition, the inner side 28 is set back to form an inner lip 32 coextensive therewith which his useful, as will be subsequently explained to retain, for example, tension bars between opposed corner members 16.

It should also be noted that cut-outs 22 are intended to be mutually spaced at predetermined regular intervals across the entire face 20. While cruciform cut-outs are shown, as will obvious to those skilled in the art other geometric designs could be used within the scope of this invention.

In addition, in one embodiment of this invention, a corner projection 34 is provided which extends from the juncture of legs 24 and 26 at the upper corner thereof. Projection 34 defines a hole 36 which is intended to be a swag mount so that a swag supporting pin or rod can be force fitted in the hole 36 to extend outwardly perpendicular to the face 20 and thereby support a swag window dressing. The side wall 30' extends around the periphery projection 34 to provide additional support. As will be obvious, corner bracket 16 can be provided without projection 34 if desired.

Figure 4:
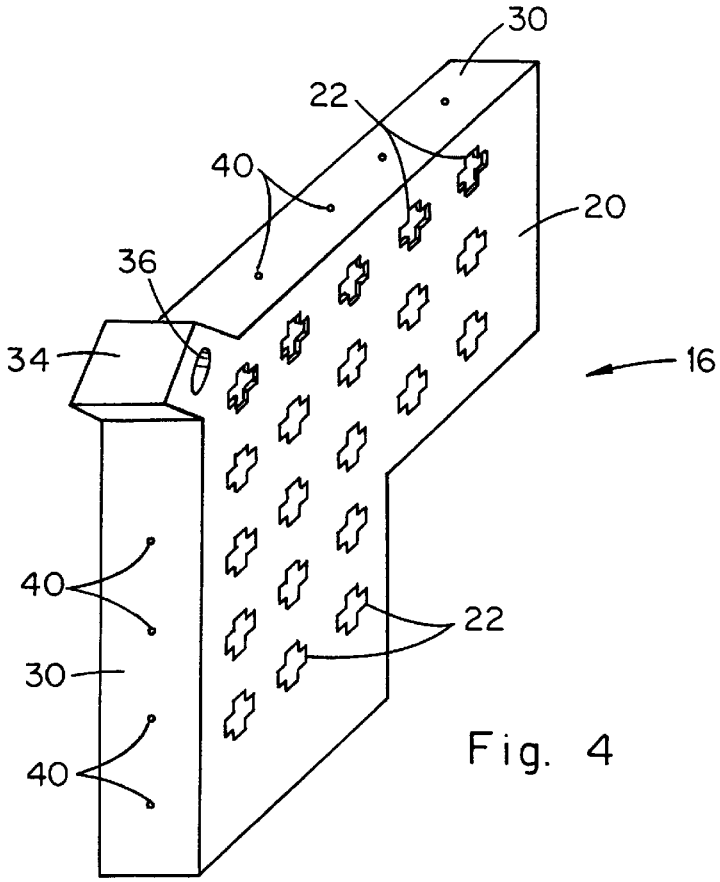
FIG. 4 is a perspective view of the corner mounting plate of FIGS. 2 and 3.
Figure 5:
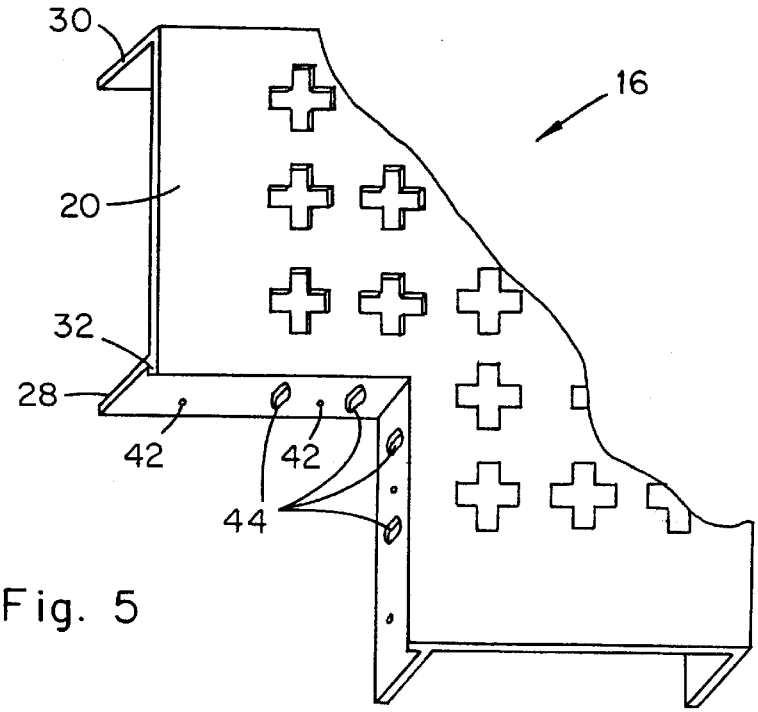
FIG. 5 is a fragmentary perspective view illustrating the interior edge of the mounting plate of FIGS. 2–4.

With attention to FIGS. 4 and 5, outer wall 30 defines mutually spaced holes 40 for attachment of a corner plate 16 to a window frame or molding. Typically thumb tacks (not shown) are manually inserted through the holes 40. In addition, inner wall 28 also defines mounting holes 42 which can be used with thumb tacks as previously described.

The spacing for holes 40 and 42, as well as the spacing of cut-outs 22 from each other is a matter of design. It is not intended that this invention be limited to specific dimensions.

Figure 6:
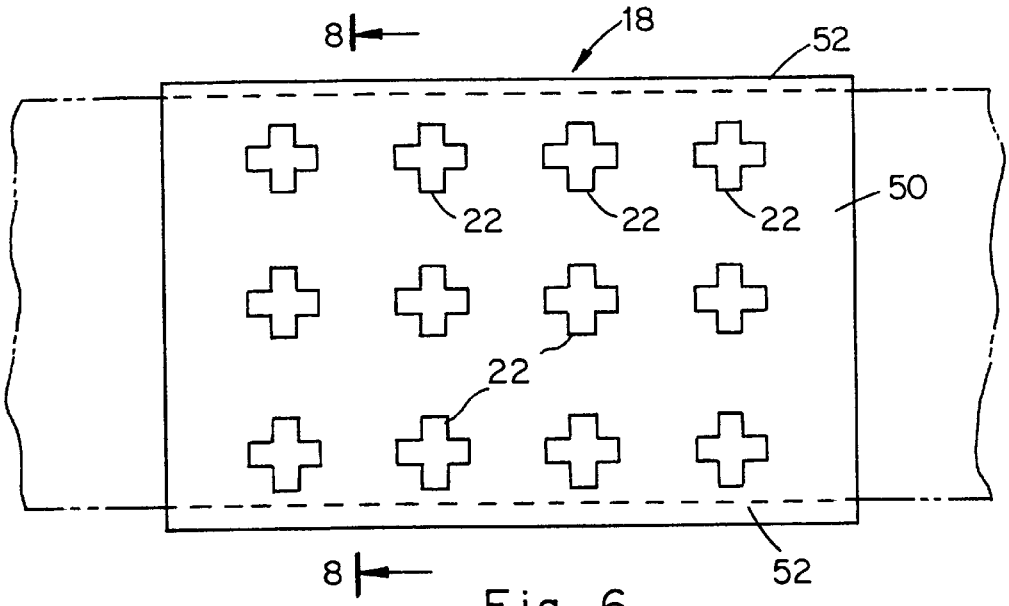
FIG. 6 is a front view of the linear base mounting plate of the device of this invention.
Figure 7:
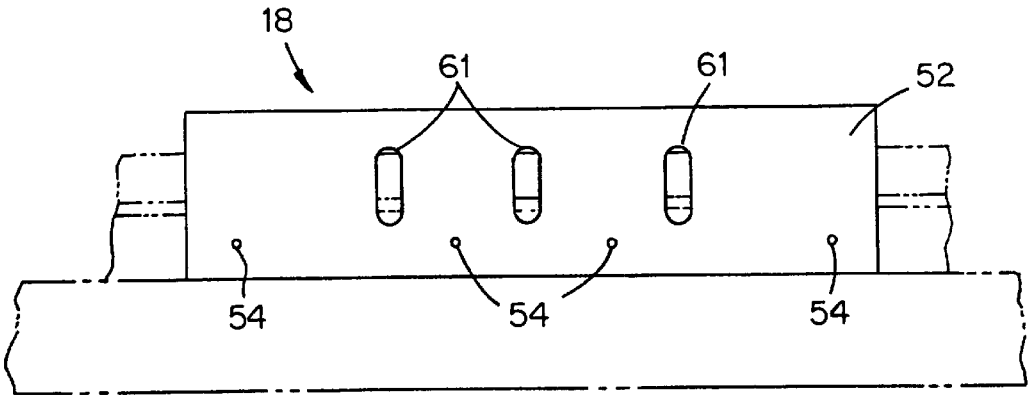
FIG. 7 is a side view of the mounting plate of FIG. 6.
Figure 8:
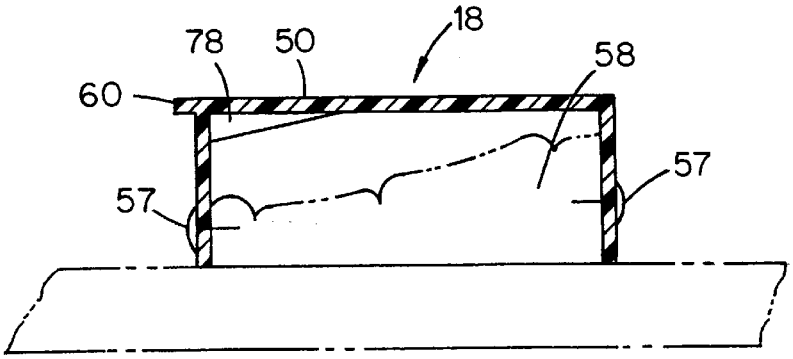
FIG. 8 is a cross-sectional view taken along lines 8—8 of FIG. 6.
Figure 9:
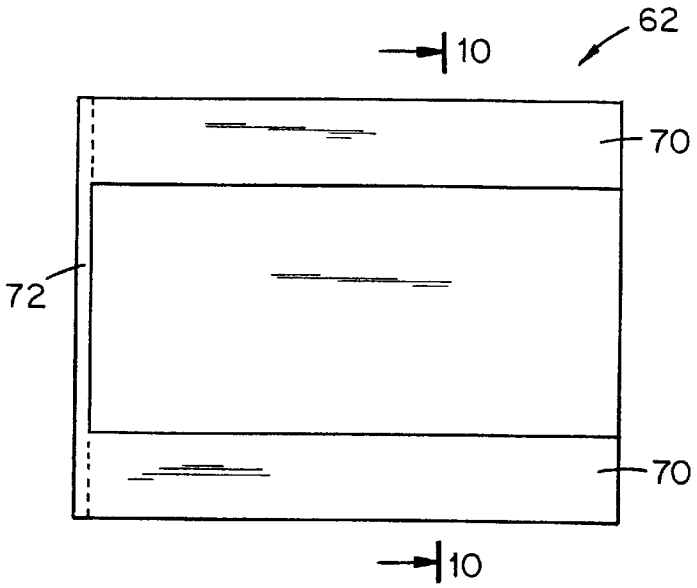
FIG. 9 is a front view of the universal clip of this invention.

With attention to FIGS. 6–8, the linear support mounting plate 18 consists of an outer face 50 and side walls 52. Side walls 52 are provided with mutually spaced holes 54 which can be used for thumb tacks 56 or the like which can be inserted in a molding 58 to mount the plate 18 thereon. In addition, a lip 60 is provided as an extension of face 50 over one of the walls 52 and lip 60 serves the same function as lip 32 to retain, for example, a tension rod between opposed such mounting plates. In addition, oval holes 61 are provided which function similarly to the holes 44 provided in corner bracket 16. That is, oval holes 61 are intended to retain a conventional mounting bracket, for example, a "mini-blind".

Figure 10:
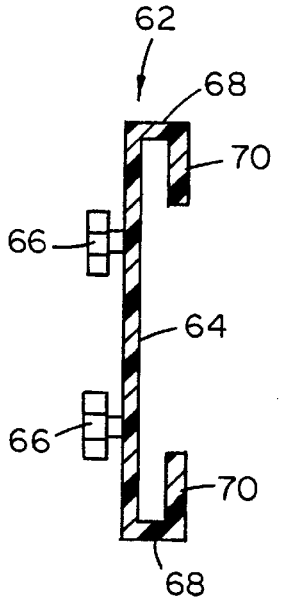
FIG. 10 is a cross-sectional view taken along lines 10—10 of FIG. 10.
Figure 11:
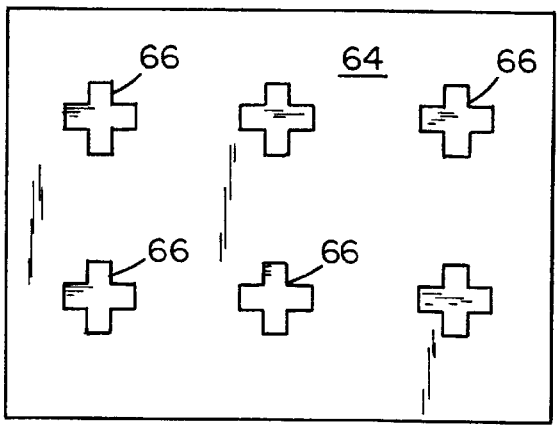
FIG. 11 is a rear view of the universal clip of FIG. 9.
Figure 12:
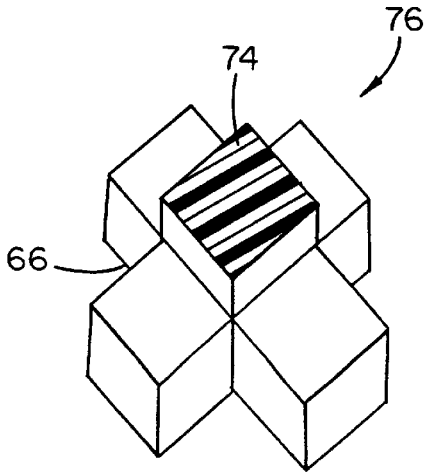
FIG. 12 is a perspective view of a clip projection with the universal clip member removed therefrom.

With attention to FIGS. 9–12, there is shown therein a universal clip member 62 which is generally channeled shaped as shown at FIG. 10 and which consists of a back plate 64 having integral projections 66 extending therefrom, upper and lower sides 68 and upper and lower track members 70 extending therefrom. A stop member 72 extends across one side of clip member 62. The stop member 72 as will be subsequently explained, functions when the clip member is disposed vertically so that the stop member 72 supports a conventional bracket which is disposed in the clip member between track members 70 and back plate 64. Similarly, spacer members can be used between stop member 72 and the conventional bracket (not shown) to facilitate alignment of the bracket relative to the clip 62.

Each projection 66 is integral with the back plate 64 and the projections 66 are mutually spaced at regular intervals. Each projection 66 has a mounting face 74 which is integral with plate 64 and supports a cruciform 76 which is dimensioned to fit in the cut-outs 22 in either mounting plate 16 or 18.

Figure 13:
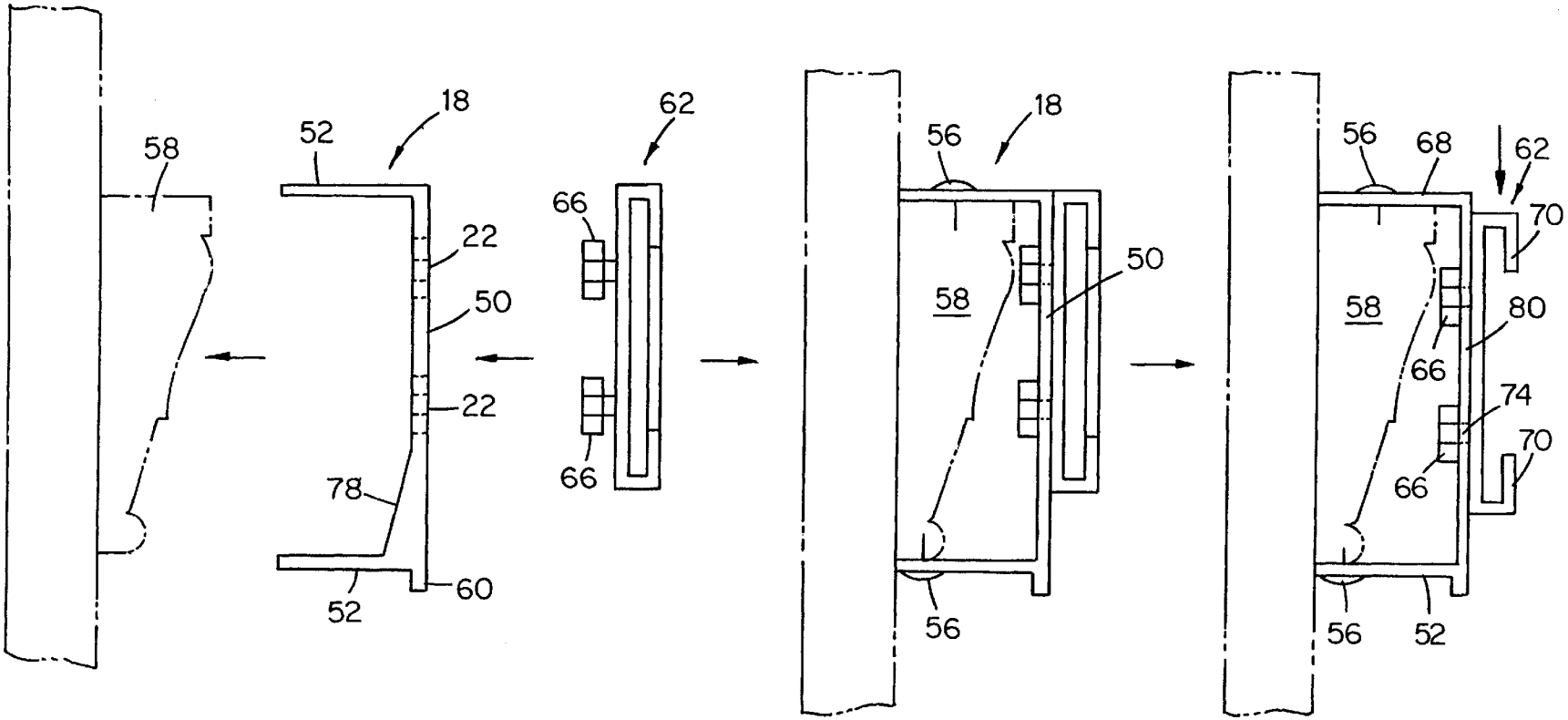
FIG. 13 is an exploded view illustrating assembly of the mounting device of this invention including downward displacement of the universal clip for locking.

With attention to FIG. 13, there is shown an exploded view of a typical mounting procedure for the device of this invention. In this instance, a molding 58 receives a linear mounting plate 18. It should be noted that in this example the molding 58 is extending horizontally. Furthermore, the Figure also illustrates a reinforcement 78 disposed within mounting plate 18 adjacent lip 60 which serves to prevent buckling of the outer plate 50 under loading.

As will be obvious to those skilled in the art the reinforcement 78 is equally applicable to corner bracket 16.

In addition, as will also be obvious to those skilled in the art the example shown in FIG. 13 is not intended to be imitative of the invention in that the linear bracket could be mounted vertically in the same fashion and lip 60 would then be directed inwardly in the window frame or molding. Furthermore, the illustration depicts a linear mounting plate and these features would be equally applicable to a corner mounting plate.

Mounting plate 18 is then secured to the molding 58 by tacks 56.

The universal clip member 62 is then mounted in the desired location on mounting plate 18 by inserting integral projections 66 into cut-outs 22. The dimensions of the cruciform design 76 correspond to the cut-out portion 22 so that once inserted, the projection and integral clip 62 will slide downwardly behind the outer wall 50 to be secured. This downward movement then seats the support members 74 in the appropriate portion of the cut-out 22 so that the track members 70 are ready to receive a conventional mounting bracket. As will be obvious to those skilled in the art, the side members 52 must be dimensioned sufficiently so that the mounting plate 18 covers the molding 58 and provides sufficient space for the projection 66 to be mounted within the mounting plate between the outer face 50 of the plate, and the molding.

Figure 14A:
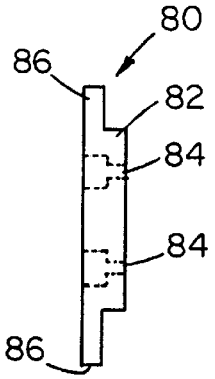
FIG. 14*a* is a side view of the interface plate of this invention.
Figure 15:
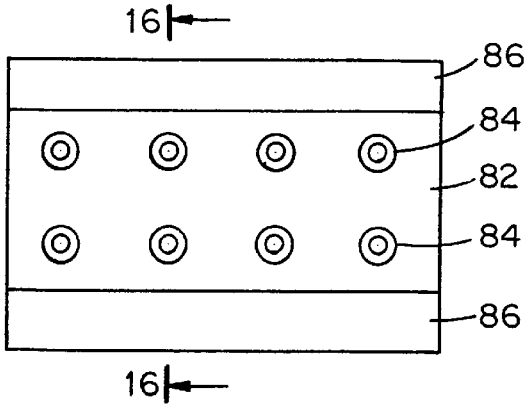
FIG. 15 is a rear view of the interface plate of FIG. 14*a*.
Figure 16:
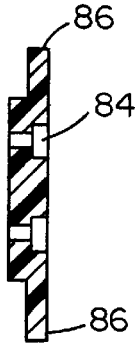
FIG. 16 is a cross-sectional view taken along lines 16—16 or FIG. 15.

With attention to FIGS. 14*a*, 15 and 16 there is described the third element of the device of this invention, an interface plate 80 which consists of a center portion 82 having holes 84 drilled therethrough and upper and lower flanges 86. Conventional screws, nails or the like are intended to extend through holes 84 as will be subsequently explained to mount the interface plate 80 to a shutter, as also will be subsequently explained. The flanges 86 are intended to ride within in the track members 70 of the universal clip 62.

Figure 14B:
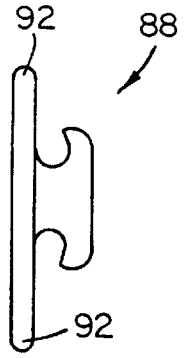
FIG. 14*b* is a side view of a conventional mounting bracket which can be received in the universal clip of this invention.
Figure 14C:
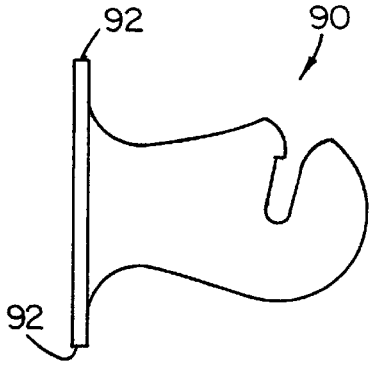
FIG. 14*c* is a view of another conventional mounting bracket which can be received in the universal clip of this invention.

FIGS. 14*b* and 14*c* illustrate two common window dressing mounting brackets 88 and 90. Both of said brackets have flange portions 92 above and below and these flange portions 92 are intended to ride within track 70 of universal clip 62 to mount the brackets therein. Once mounted, the brackets 88 or 90 then can be used to suspend the window dressing in the conventional fashion.

Figure 17:
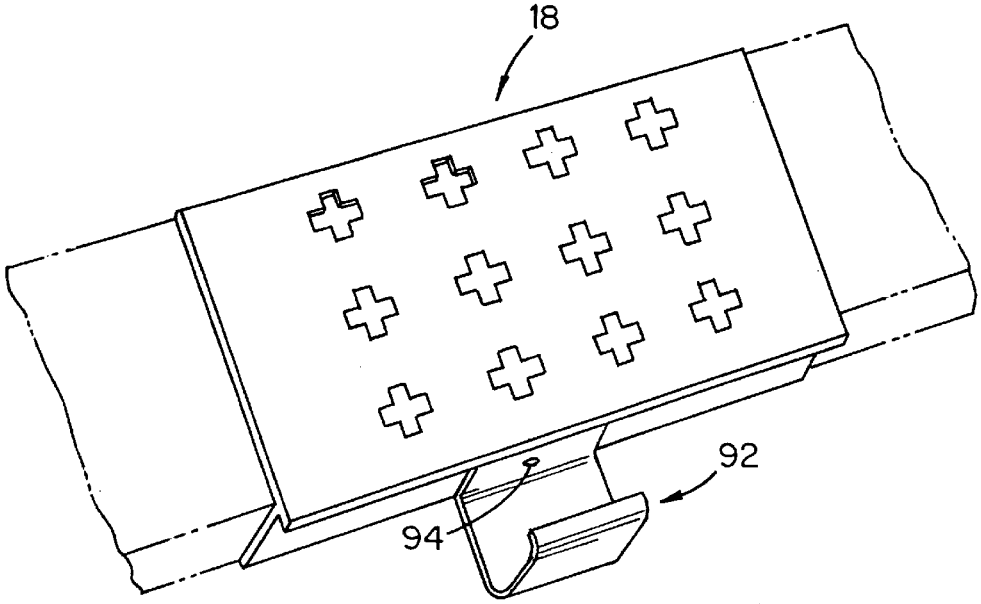
FIG. 17 is a perspective view of a linear mounting plate holding a conventional mounting hook.

With attention to FIG. 17, FIG. 17 shown a special purpose adaptation of the linear mounted plate 18 wherein a conventional bracket 92 mounted by a nut and bolt fastener 94 through a hole 61 can provide a central support for a "mini-blind" or the like. This utilizes the conventional bracket 92 without the universal clip 62.

Figure 18:
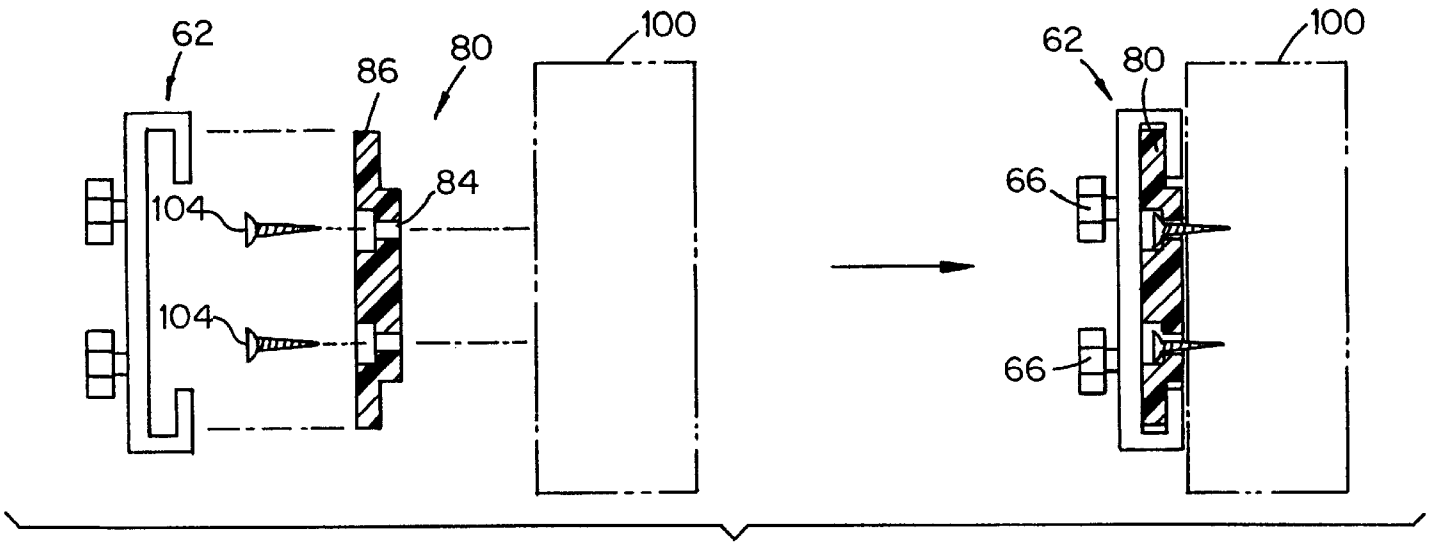
FIG. 18 is an exploded view illustrating assembly of the interface plate of this invention using screws.
Figure 19:
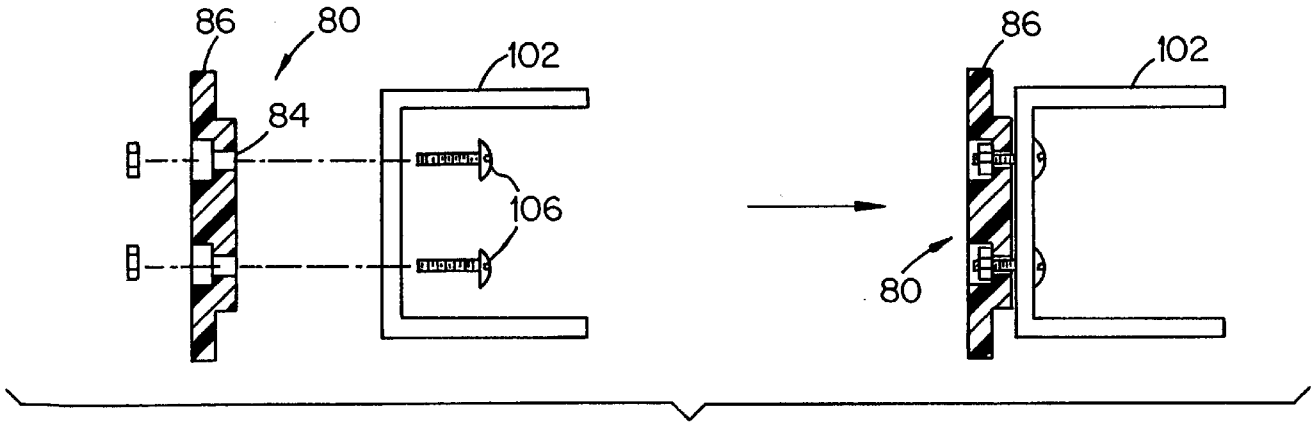
FIG. 19 is an exploded view illustrating assembly of the interface plate of this invention using bolts.

With attention to FIGS. 18 and 19 there is shown therein alternate ways of mounting the interface plate 80 on a shutter side 100, or on a "mini-blind" mounting bracket 102. In the case of the shutter 100 wood screws 104 are shown which secure the interface plate 80 through holes 84. In the case of the "mini-blind" bracket 102, bolts 106 are used which also extend through holes 84.

Figure 20:
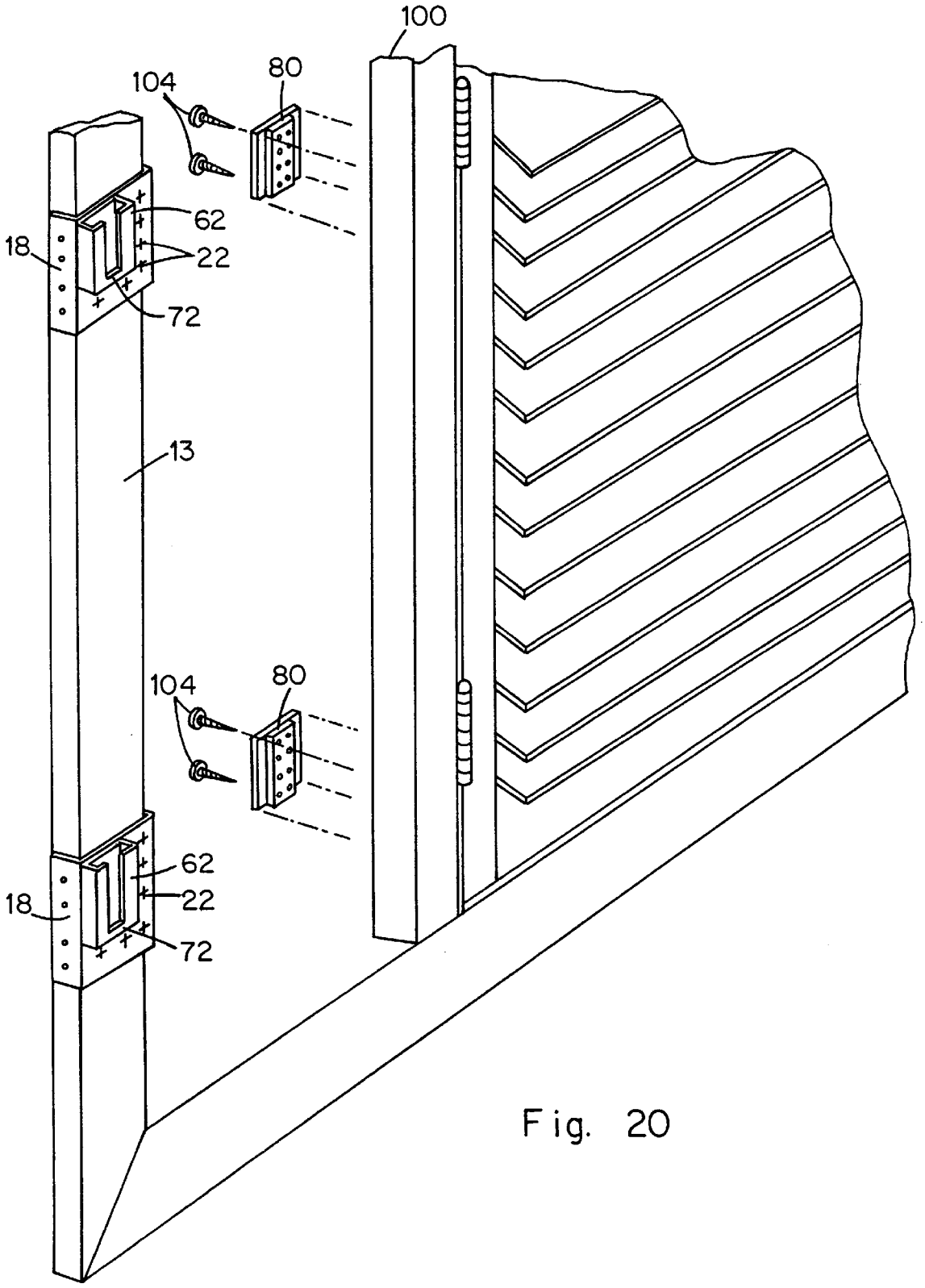
FIG. 20 is an exploded view illustrating a shutter mounting using the device of this invention.

To further illustrate mounting a shutter attention is directed to FIG. 20. In FIG. 20, the shutter side 100 mounts interface brackets 80 with wood screws 104 as shown in FIG. 18. The window frame 13 then mounts a pair of linear mounting plates 18 as above described, and plate 18 in turn mount universal clips 62 which have stop members 72 disposed at the lower end thereof.

The shutter 100 is then mounted on the frame 13 by sliding the interface brackets 80 downwardly into the clips 62 until they rest upon stop member 72. The shutter is then mounted. As will be obvious to those skilled in the art the presence of additional holes or cut-outs 22 in mounting plates 18 will facilitate the movement of universal clip 62 until the shutter 100 is oriented relative to the frame 13 as desired.

Figure 21:
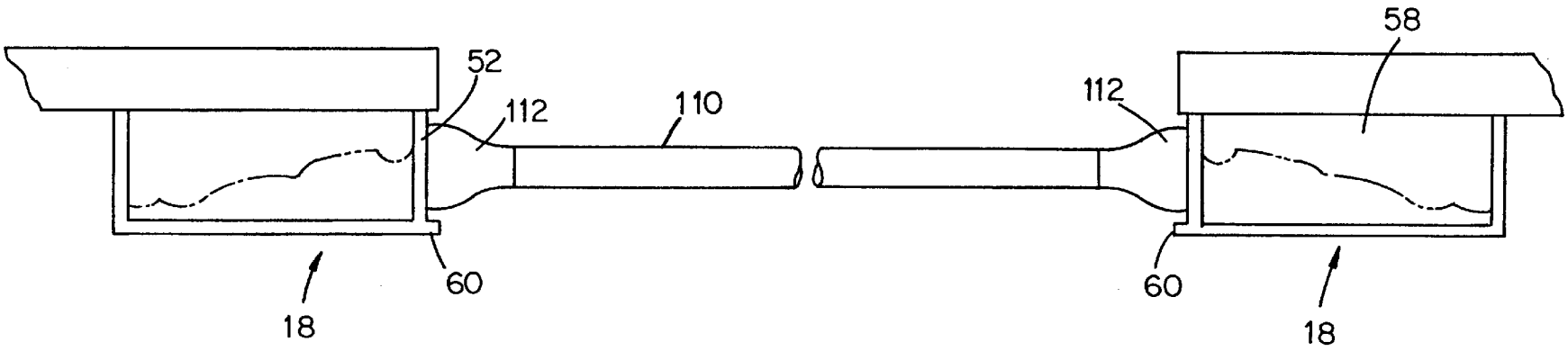
FIG. 21 is a top view of mounting plates of this invention used to mount a conventional spring loaded rod.

With reference to FIG. 21, there is shown for exemplary purposes therein, the mounting of a tension rod 110 having rubber foot portions 112 which are urged against the side walls 52 of linear mounting plates 18 and retained therein by lip 60. As will be obvious to those skilled in the art the conventional tension rod 110 with its internal spring biases the ends 112 outwardly so that rod 110 is substantially rigidly suspended between opposed mounting plates 50. A curtain can then be suspended from rod 110, or any other similar type of decorative or functional member can be suspended therefrom. As also will be obvious to those skilled in the art, if it would be desired to install a tension rod at the upper portion of a window frame, in all likelihood corner mounting plates 16 would be substituted for linear mounting plates 18 and the lip member 60 would be the lip member 32. FIG. 21 would in this case be a cross-sectional view.

As also will be obvious to those skilled in the art in the case of a tension rod, the mounting plate 50 need not be U-shaped as shown in FIG. 21. Instead the wall 52 and lip 60 are the only elements necessary and the face 50 and opposite side wall 52' could be eliminated.

Figure 22:
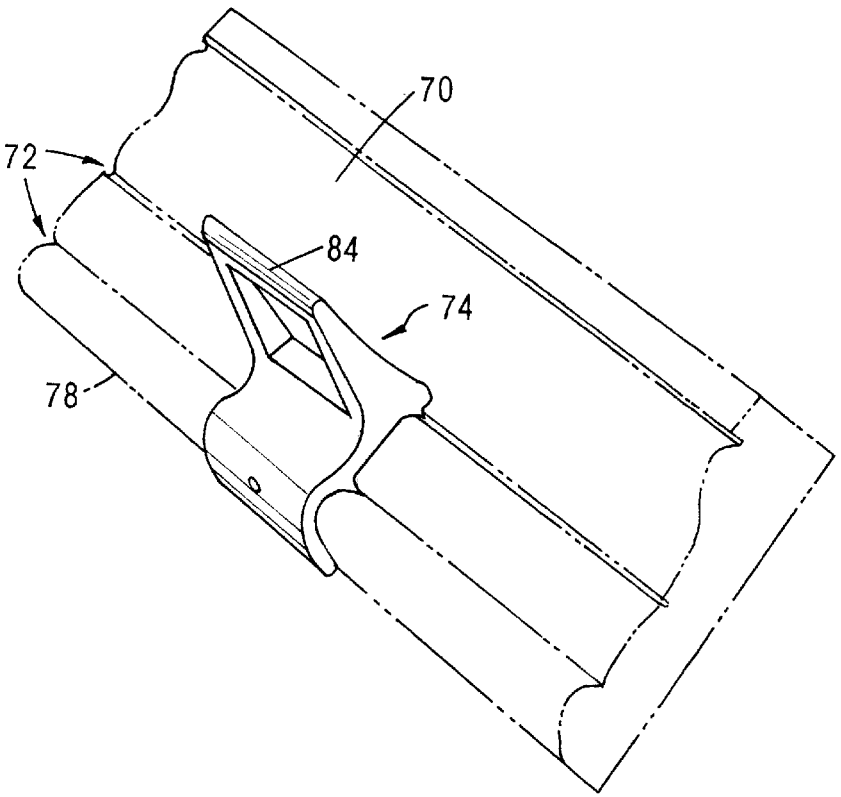
FIG. 22 is a perspective view of another embodiment used to mount a spring loaded rod showing a portion of the mounting frame in phantom.
Figure 23A:
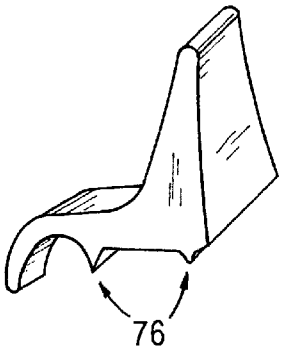
FIG. 23*a* is a rear perspective view of the embodiment of FIG. 22.
Figure 23B:
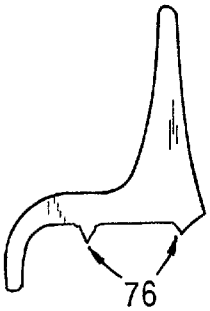
FIG. 23*b* is a side view of the embodiment of FIG. 22.
Figure 23C:
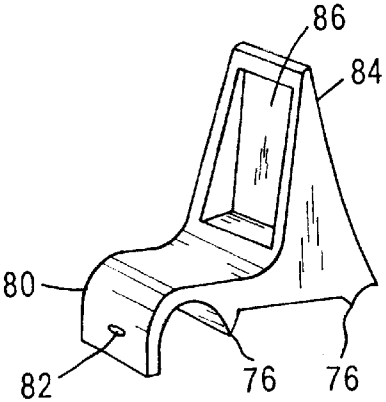
FIG. 23*c* is a front perspective view of the embodiment of FIG. 22.

In the embodiment shown in FIG. 22, the molding 70 has a variety of grooves 72 in the face thereof and in this embodiment the bracket of this invention 74 does not cover the entire face of the molding. As shown in FIGS. 23*a, b,* and *c*, stops 76 are provided in the lower face adjacent the inside surface 78 of the molding and the stops 76 are intended to rest in the grooves 72. As shown in FIG. 23*b*, a single stop 76 can be provided if desired.

The inner surface 78 of the molding 70 is overlapped by bracket portion 80 which has a hole 82 therethrough for a thumb tack or the like. Upstanding tension rod support portion 84 has an interior rectangular depression 86 within which the rubber foot portion 112 of rod 110 is retained. See FIG. 21.

Figure 23D:
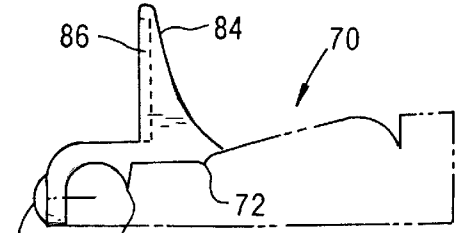
FIG. 23*d* is a side view of the embodiment of FIG. 22 showing the frame portion in phantom.
Figure 23E:
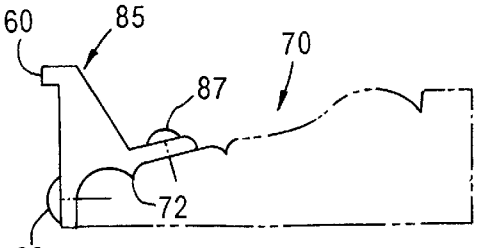
FIG. 23*e* is a side view similar to FIG. 23*d* showing an alternative embodiment similar to FIGS. 21 and 22.

With attention to FIGS. 23*d* and *e*, a single thumb tack 83 can be provided or in the alternative thumb tacks 83 and 87 may be used. Thumb tack 87 of course is in the face of molding 70 and that may not be desired. In the embodiment shown in FIG. 23*e*, the upstanding portion 85 uses a lip 60 to retain the foot 112 as shown in FIG. 21 instead of the rectangular depression 86 shown in FIG. 23*d*.

Figure 24:
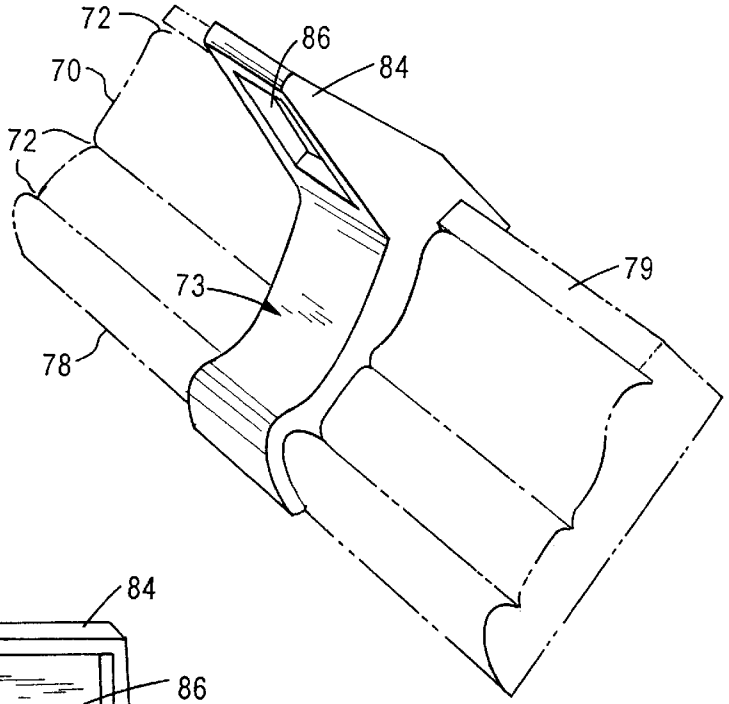
FIG. 24 is a perspective view of another embodiment of the device of this invention showing the mounting frame in phantom.
Figure 25A:
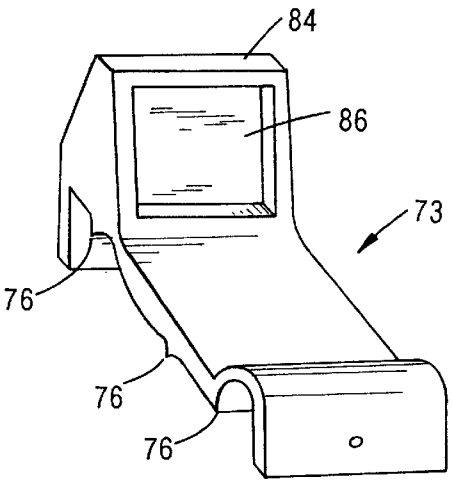
FIG. 25*a* is a front perspective view of the embodiment of FIG. 24.
Figure 25B:
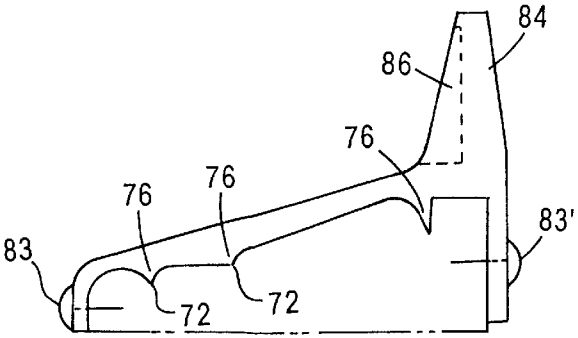
FIG. 25*b* is a side view of the embodiment of FIG. 24.

With attention to FIGS. 24 and 25*a* and *b*, this embodiment also can be extended across the entire face of the molding 70 as shown in FIG. 24. In this embodiment, the inner face of the molding 78 is covered, and all three grooves are covered along with the outer face 79 of the molding. An upstanding portion 84 is provided with an interior depression 86 to retain the foot 112 of the tension rod 110, and depending stop members 76 are provided to fit into all three grooves 72 in the face of molding 70. An upstanding member 84 is provided for receipt of the foot 112 of the tension rod 110 and if desired, an additional thumb tack 83' can be used in the outside face of molding 70. The embodiment of FIG. 25*b*, in contrast to the embodiment of FIG. 21 achieves the equivalent result in a contour formed bracket member 73 which covers the entire face of molding 70.

Figure 27C:
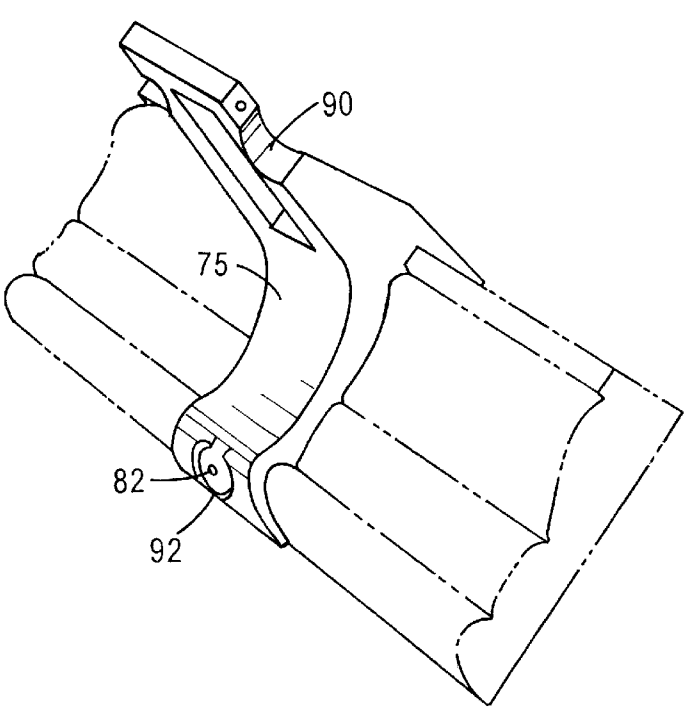
FIG. 27*c* is a perspective view of the embodiment of FIGS. 27*a* and *b* showing a mounting frame portion in phantom.
Figure 27B:
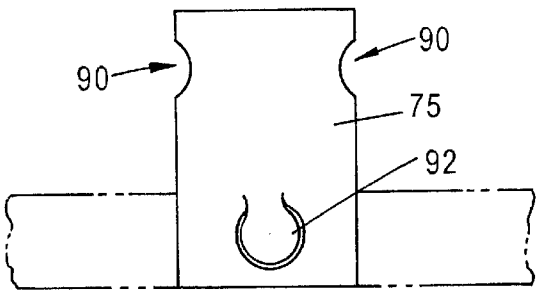
FIG. 27*b* is a rear view of embodiment 27*a;*
Figure 27A:
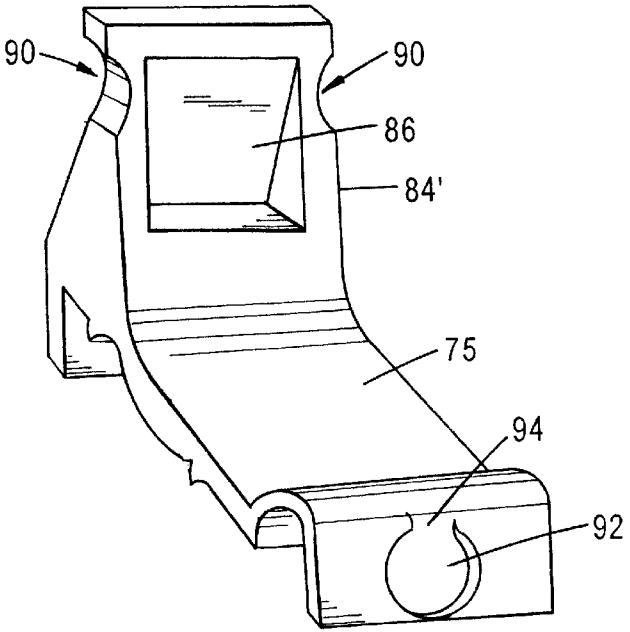
FIG. 27*a* is a front perspective view of yet another embodiment of this invention'

With reference to FIGS. 27*a–c* the embodiment 75 shown therein is similar to the embodiment of FIGS. 24 and 25*a–c* with the exception that the upstanding member 84' has opposed radial grooves 90 therein which could be used to support a curtain rod or the like. A depression 86 is provided in member 84 in the same fashion to retain a foot 112 of a tension rod 110 so that either or both a tension rod or conventional curtain rod could be used with this embodiment 75.

In addition, a depression 92 is provided surrounding the hole 82 to receive the tack 83 and a cut-out inclined portion 94 can be provided whereby a pointed or flat instrument can be used to pry the tack 83 out of the molding if it is desired to remove the bracket 75.

Figure 28A:
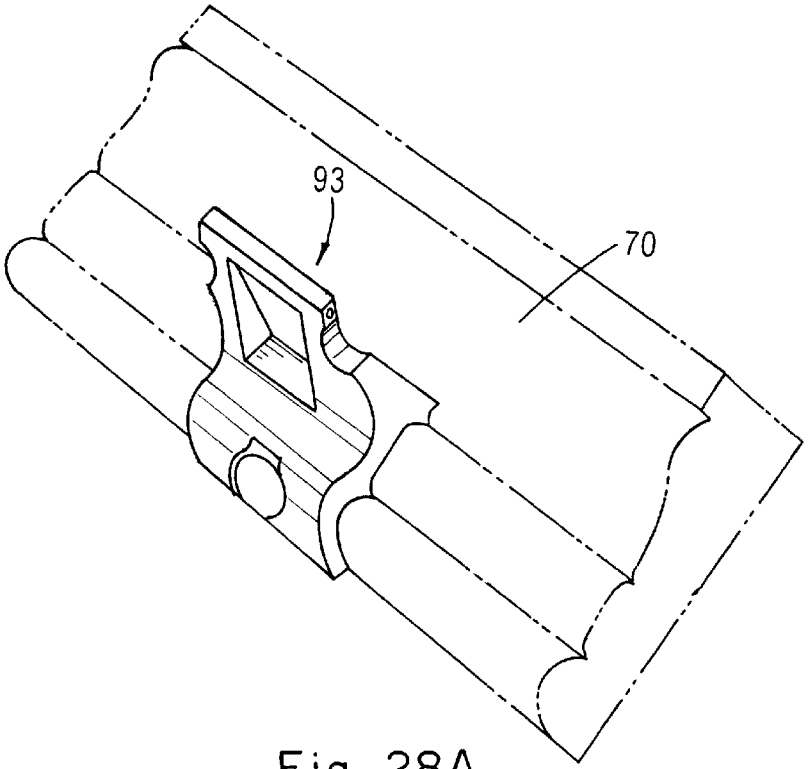
FIG. 28*a* is yet another embodiment of this invention shown in perspective on a mounting frame shown in phantom.
Figure 28C:
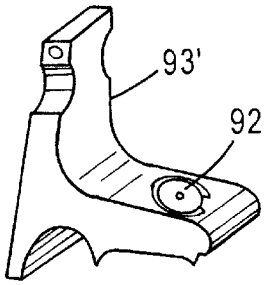
FIG. 28*c* is a rear perspective view of the embodiment of FIG. 29*b.*
Figure 28B:
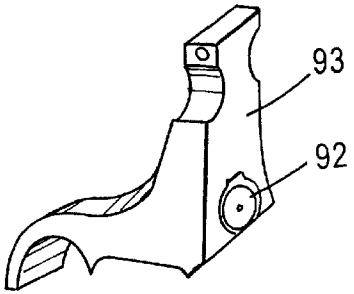
FIG. 28*b* is a rear perspective view of the embodiment of FIG. 28*a;*

Embodiments shown in FIGS. 28*a–c* and 29*a* and *b* are similar to the embodiment shown in FIGS. 22 and 23*a–d* in that they cover only a portion of the molding 70. As shown in FIGS. 28*b* and *c* depressions 92 are provided to receive tacks (not shown). In addition, embodiment 93 is intended to be mounted on the inner edge portion and extending mid width of the molding 70 as shown in FIG. 28 whereas the embodiment 93' of FIG. 28*c* is intended to be mounted on the inner edge and affording a functional stop at the inner edge of molding 70.

Figure 29B:
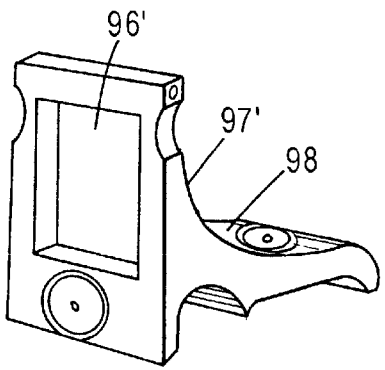
FIG. 29*b* is a front perspective view of yet another embodiment of the mounting plate of this invention.
Figure 29A:
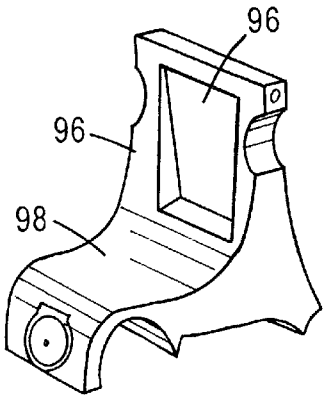
FIG. 29*a* is a perspective view of an embodiment similar to FIG. 28*a;*

With attention to FIGS. 29*a* and *b*, in this embodiment the retentive face 96 of embodiment 97 is located facing toward the portion 98 of the bracket 97 which extends over the molding (not shown). In contrast, in the embodiment of 97' of FIG. 29*b*, the position is reversed in the portion 98' which extends over the molding (not shown) is adjacent the face opposite that forming the depression 96'.

Figure 29C:
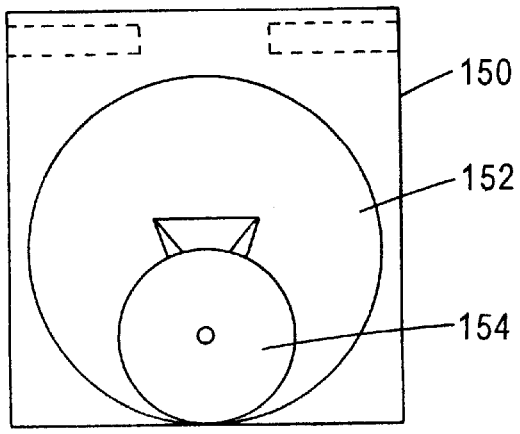
FIG. 29*c* is another embodiment of a small bracket used for tension rods and the like shown in front view.
Figure 29D:
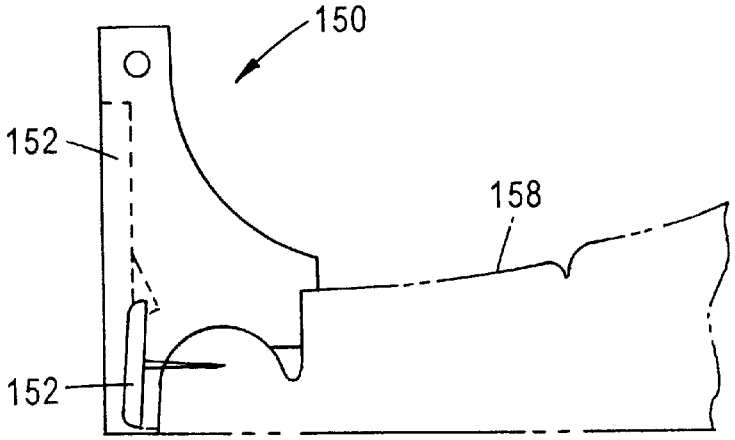
FIG. 29*d* is a side view of the single tack embodiment shown in FIG. 29*c;*

In FIGS. 29*c* and *d* a similar bracket 150 is provided having a retentive face 152 for receiving an end of a tension rod (not shown) and a well 154 is provided for a single tack 156 for mounting in a molding 158 as shown in FIG. 29*d*.

Figure 29E:
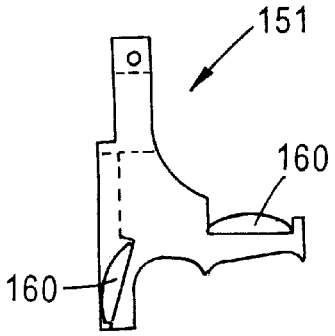
FIG. 29*e* is another embodiment of the bracket of this invention for tension rods and the like utilizing two tacks for mounting.

In FIG. 29*e*, a second tack well 160 is provided so that the embodiment 151 shown therein uses two tacks 160 for mounting in a molding (not shown).

Figure 26:
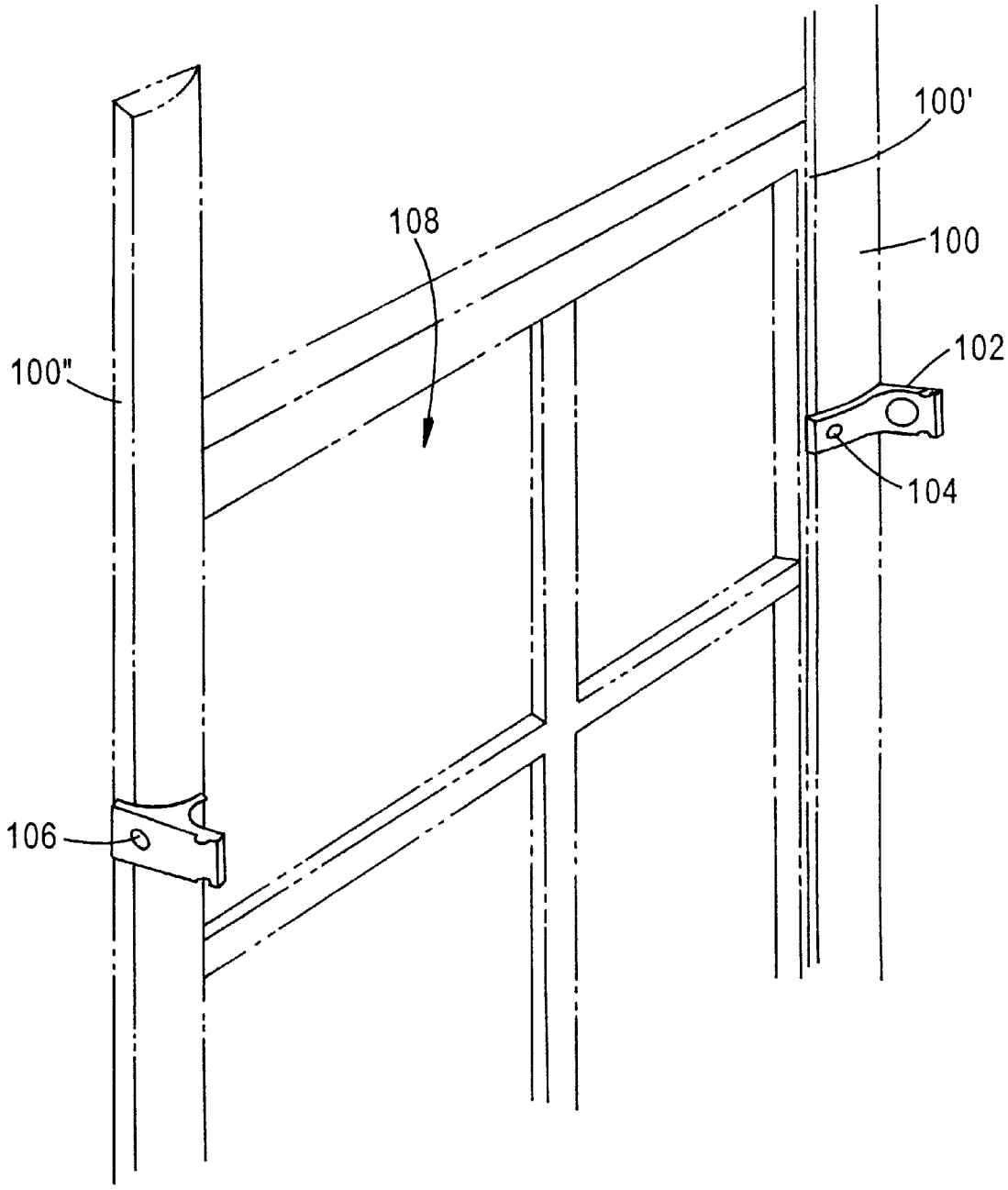
FIG. 26 is a perspective view showing opposed mounting plate embodiments of this invention on a window frame shown in phantom framing a window also shown in phantom.
Figure 30:
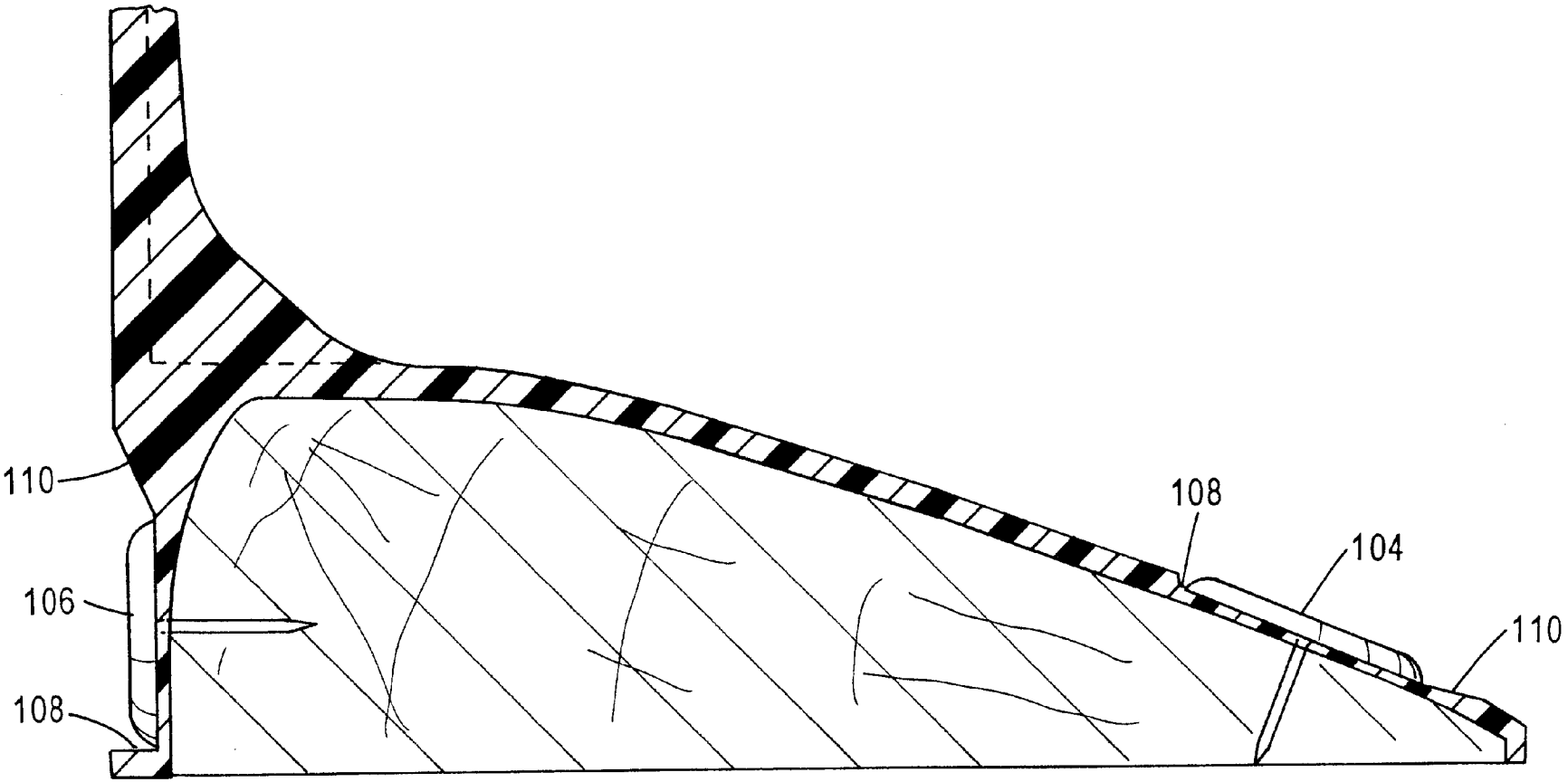
FIG. 30 is a cross-sectional view of an embodiment of the mounting plate of this invention for mounting a spring loaded rod onto ranch molding.

In the foregoing embodiments a colonial type molding has been used with special purpose brackets which are contoured to fit into the face of the molding in contrast the embodiment of FIG. 21 wherein the bracket is U-shaped. In a ranch type molding 100, the grooves 72 are not present and the surface is smooth as shown in FIG. 26. In that case the embodiment 102 utilizes tacks 104 along the inner surface of the molding 100 and 106 along the back surface. As will be obvious to those skilled in the art the inner portion of molding 100 adjacent the window 108 is too thin to support a tack in the inner face 100' whereas the outer face 100" is thick enough to support a tack. As shown in FIG. 30, a recessed well 108 can be provided for the tack 104 and a similar well 108' for the tack 106. In addition, an inclined portion 110 is provided adjacent recessed portion 108' to assist in prying the tack 106 loose from the molding 100 if desired.

Figure 31C:
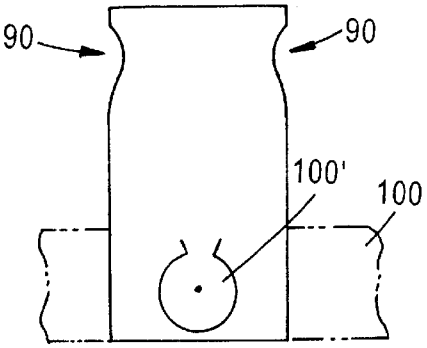
FIG. 31*c* is a rear view of the embodiment of FIG. 30.
Figure 31B:
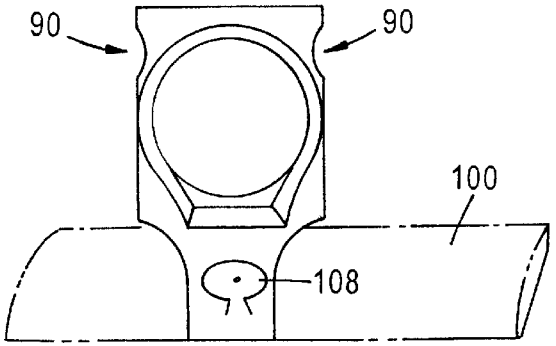
FIG. 31*b* is a front view of the embodiment of FIG. 30.
Figure 31A:
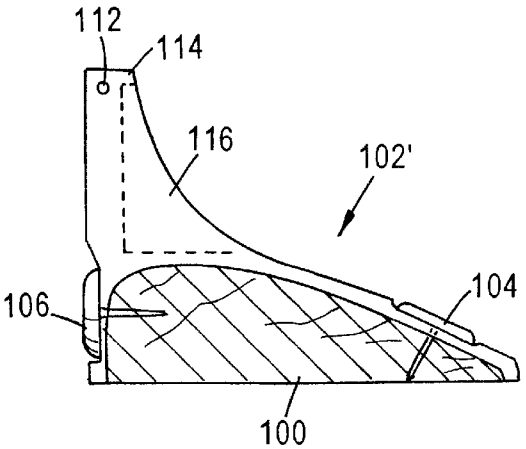
FIG. 31*a* is a side view of the embodiment of FIG. 30.
Figure 32:
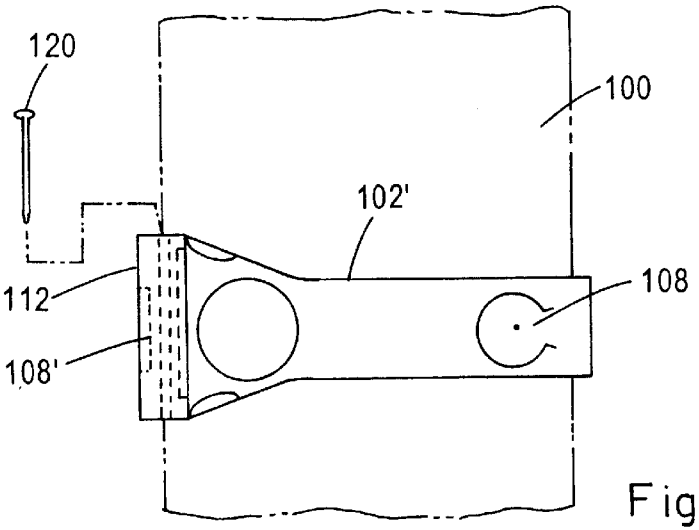
FIG. 32 is a top view of the embodiment of FIG. 30.

As shown in FIG. 31*a*, a hollow bore 112 can be provided in the upward extending portion 114 to place a retentive post therein (not shown) when needed. The rectangular or circular depression 116 is intended to receive the foot 112 of a tension rod 110 as previously described. In the embodiment of FIG. 32, a brad 120 is intended to be inserted in hole 112 as shown.

In the embodiments shown in FIGS. 31*b* and *c*, retentive notches 90 are also provided as desired for rests to cradle a passive curtain rod.

As shown in these embodiments of FIGS. 22–32, the brackets are easily attached to the corresponding molding with thumb tacks and are easily removed with minimal marring of the molding. The opposing brackets all provide seats for the rubber footed pads of the tension rods and grooves to cradle curtain rods in certain embodiments. The brackets in all embodiment of this invention may be painted to minimize their visual impact on the window and as will be obvious to those skilled in the art the colonial style molding shown can be any type of molding if it is desired to provide brackets which fit the contours thereof.

The following are additional modifications of the embodiment above described utilizing common features with variations for attachment of window hangings to various window frames, moldings and the like.

Figure 33A:
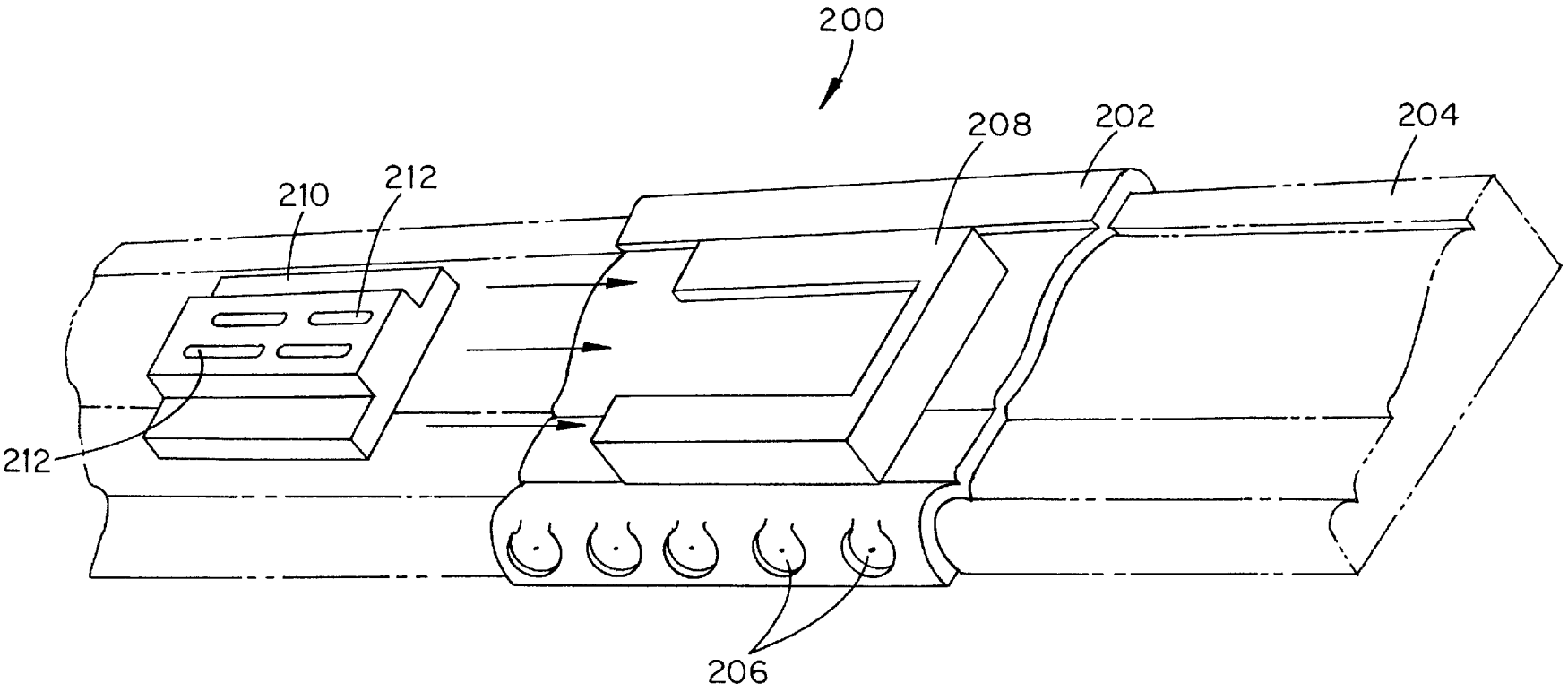
FIG. 33*a* is a perspective view of a modified base plate of this invention utilizing a sliding shutter attachment interface place.

With attention to FIG. 33*a*, this embodiment 200 a base plate 202 is mounted on a molding 204 at tack wells 206. The plate 202 mounts on its upper surface a U-shaped clip 208 for receiving a sliding plate 210. Plate 210 on its upper surface has retention clips 212 for retaining conventional shutter hardware.

Figure 33B:
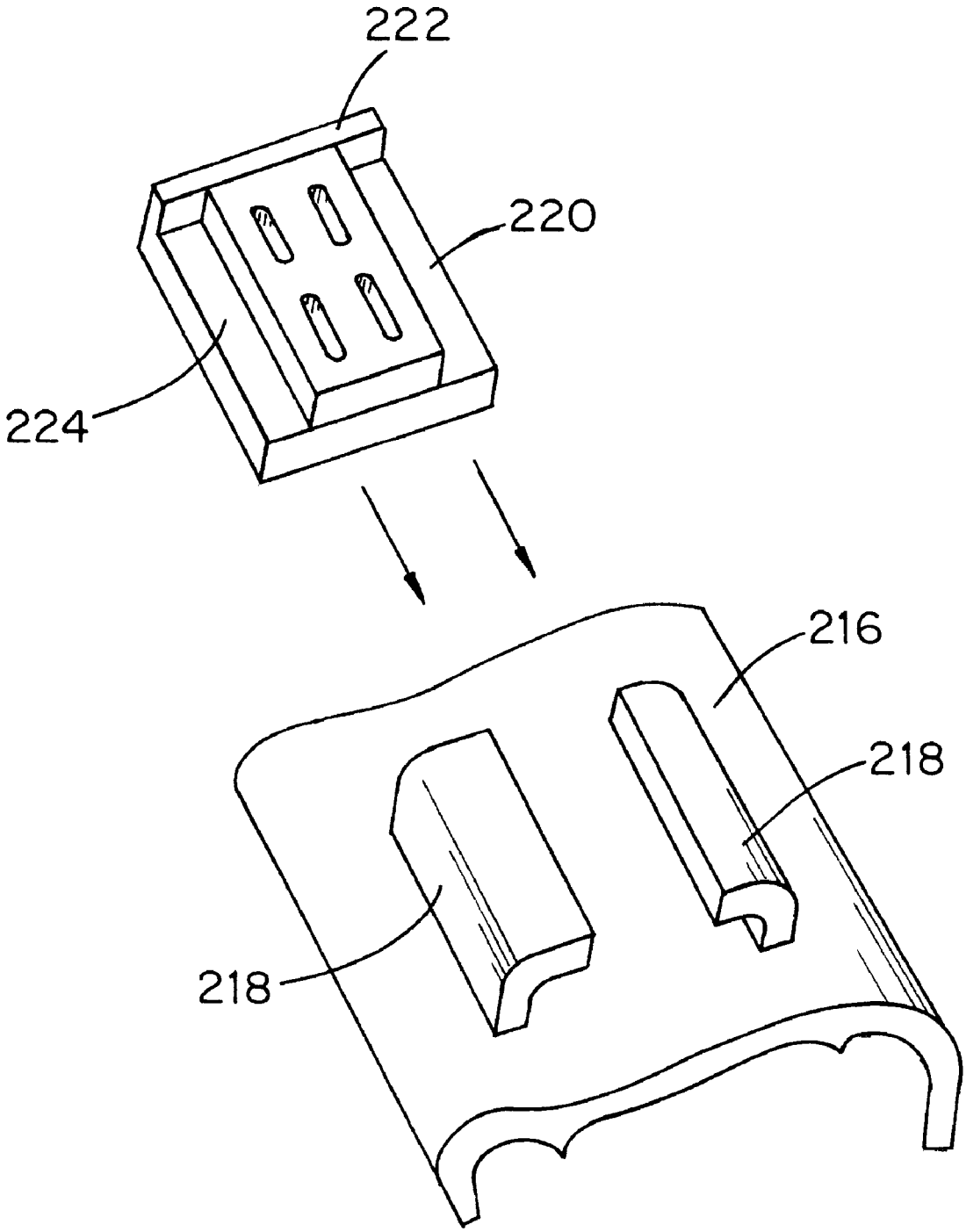
FIG. 33*b* is an embodiment similar to FIG. 33*a* wherein the sliding interface plate has a stop configuration.

In the embodiment of FIG. 33*b*, the mounting plate 216 is provided with upstanding opposed L-shaped tracks 218 which receive a sliding plate 220 which has a stop member 222 thereon for retaining the plate 220 within the tracks 218. A similar bracket member 224, similar to 212 in FIG. 33*a* is provided on the upper surface of the plate 220.

Figure 33C:
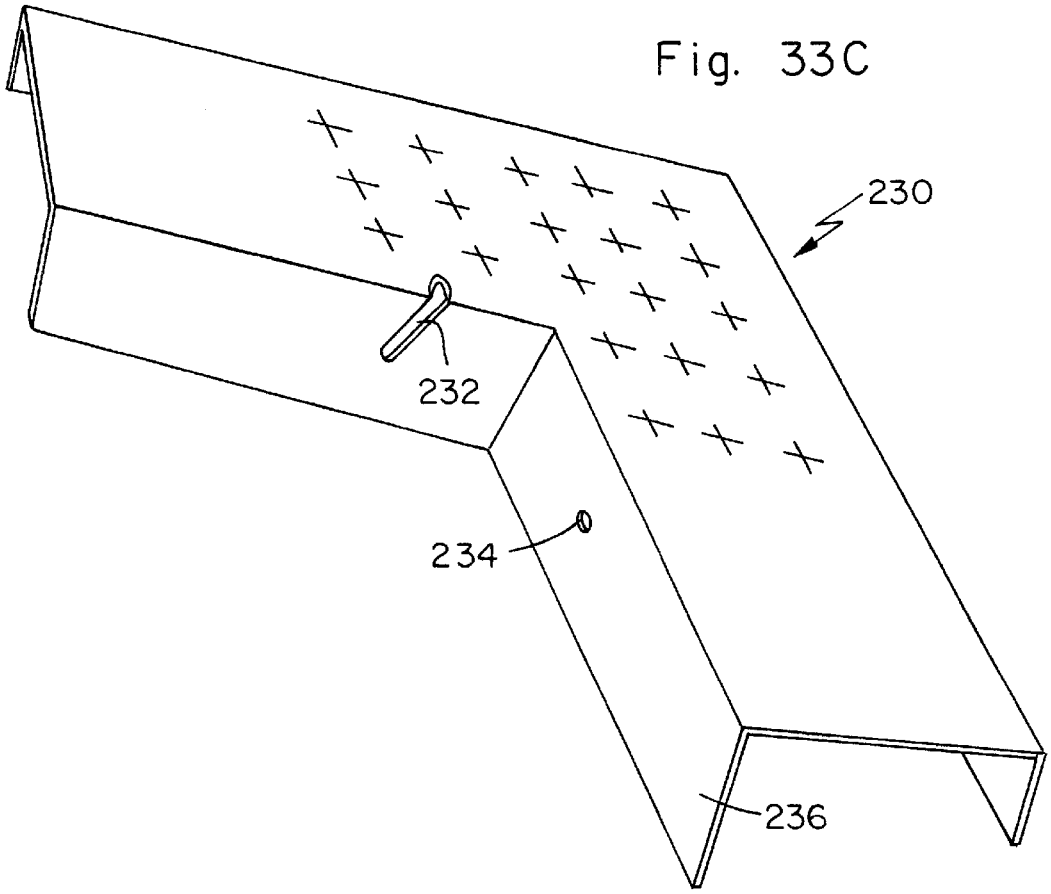
FIG. 33*c* is a corner base plate showing a cut-out in the inside flange and hole therein for mounting shades.
Figure 33D:
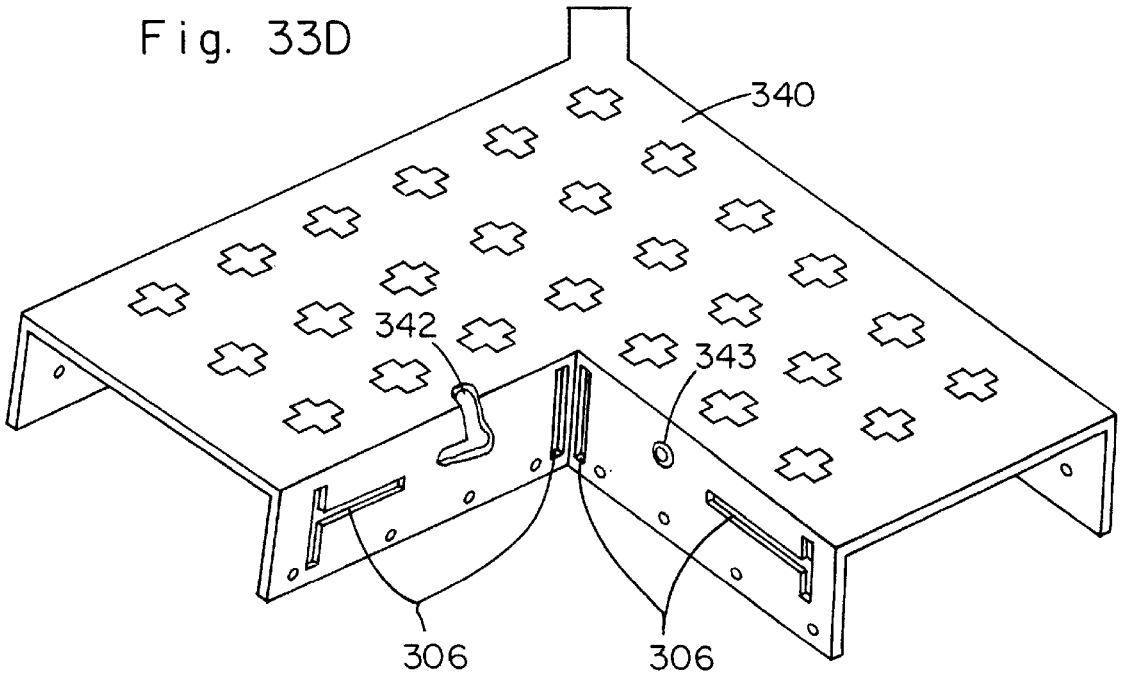
FIG. 33*d* is a view similar to FIG. 33*c* showing two cut-outs for mounting pull shades and slots for mini-blinds in a corner base plate.

If it is desired to mount convention roll-up shades, mini-blinds or the like wherein the window hanging is on a roller having pins axially located at either end, it is necessary to provide corner plates having mounts for said pins. With attention to FIG. 33*c*, a corner plate 230 according to this invention can have both a slot 232 or a pin hole 234 on the inner flange 236 to receive the pins. In this way, one pin is inserted in the hole, and in the opposing bracket the opposite pin is inserted in the slot to mount the roll-up shade on the window frame. In the embodiment of FIG. 33*d*, the corner base plate 340 can have slots 306 and a pair of cut-outs 342 and 343 on the inner flange.

Figure 33E:
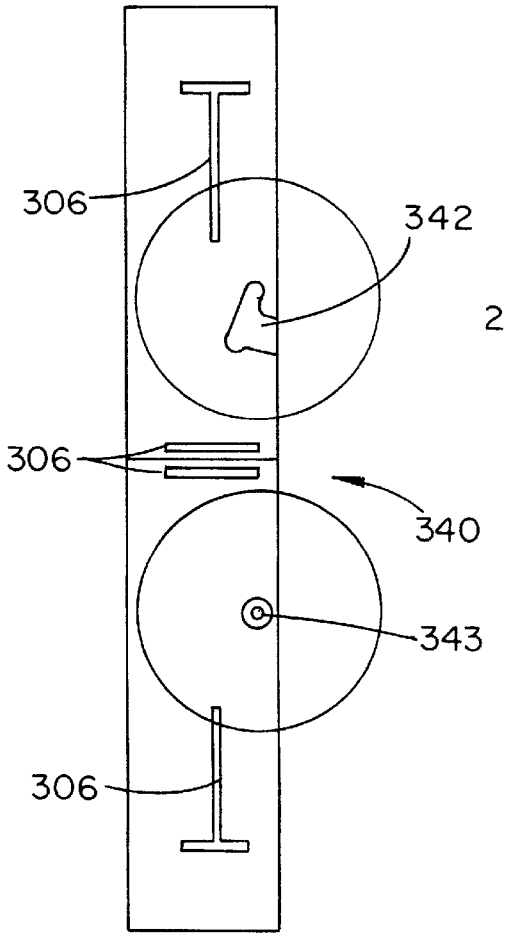
FIG. 33*e* is a schematic view of a left corner bracket flange flattened in a vertical position and showing the cut-outs and slots in use for shades and mini-blind retention clips.

FIG. 33*e* is a schematic view showing the inner surface or flange of 340 rotated into a vertical position wherein cut-outs 342 and 343 for shades pins and a slot 306 for the retentive clip of the mini-blind brackets are positioned.

Figure 34:
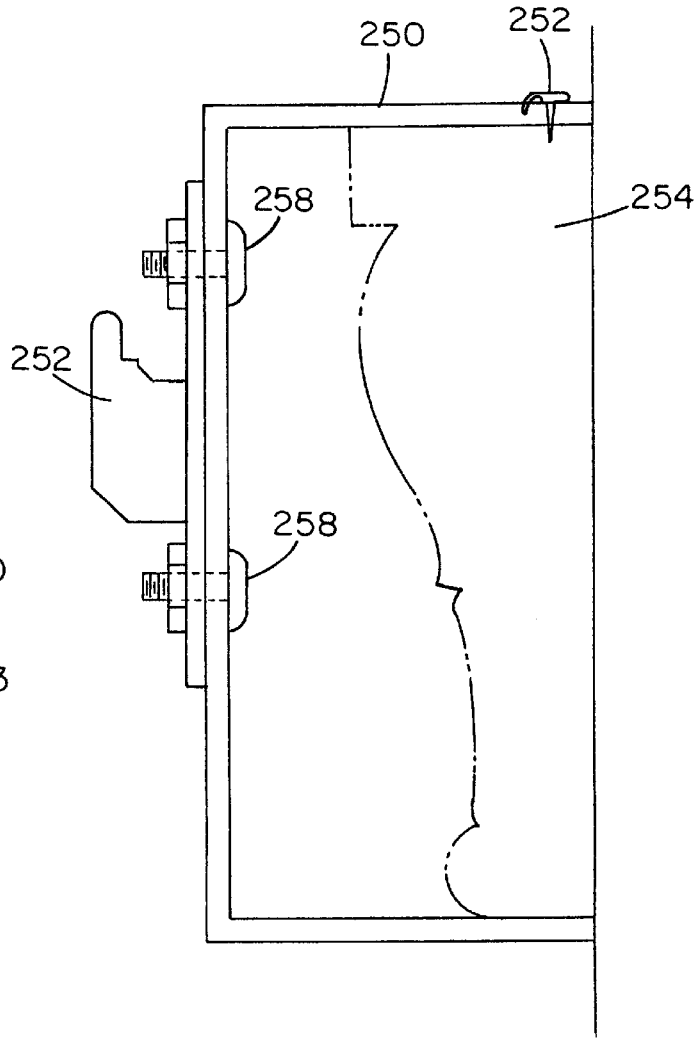
FIG. 34 is a side view in cross-section of an alternate embodiment using a nut and bolt combination for mounting a bracket on a base plate of this invention.

With reference to FIG. 34, the base plate of this invention 250 secured by a tack 252 to a molding 254 can mount a hardware bracket 256 with conventional nut and bolt combinations 258. In this case, the bracket 256 will be assembled to the plate 250 before it is mounted on the molding 254 as shown in FIG. 34. Both corner and linear base plates can accommodate such hanging brackets with a simple nut and bolt combination. This would eliminate the "universal" clip of this invention in a situation where the size, shape, thickness, or the like makes it less useful or desirable.

Figure 35:
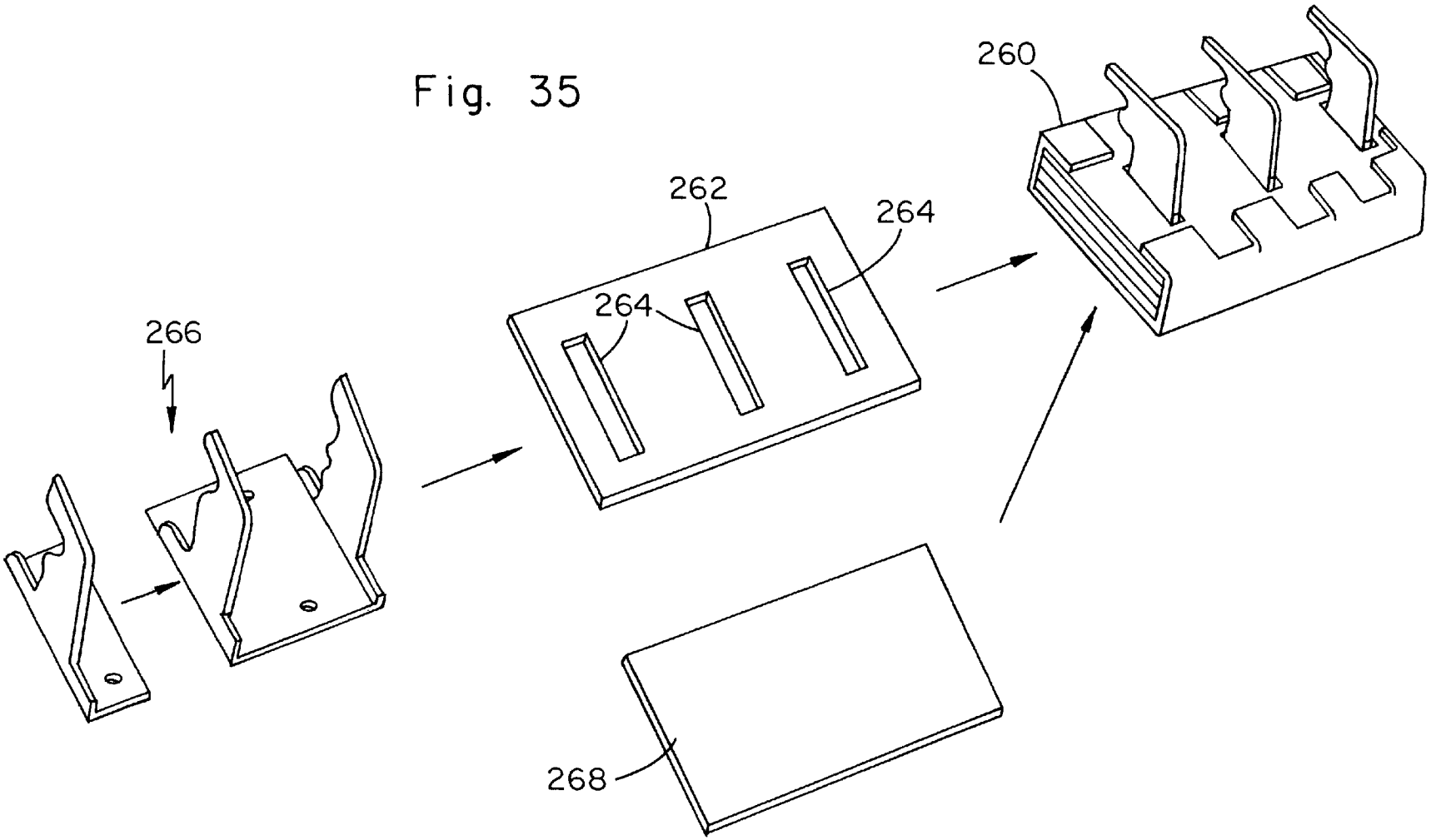
FIG. 35 is an exploded view showing a bracket stabilizer and blank shim used to assemble curtain rod brackets into a universal clip.

With attention to FIG. 35, in this embodiment, a universal clip 260 is intended to receive a bracket stabilizer 262 slidably as shown. Bracket stabilizer 262 has slots 264 which receive one or more brackets 266 as shown. A shim 268 is provided in the assembly of the clip 260 to prevent wobble when the device is assembled.

Figure 36A:
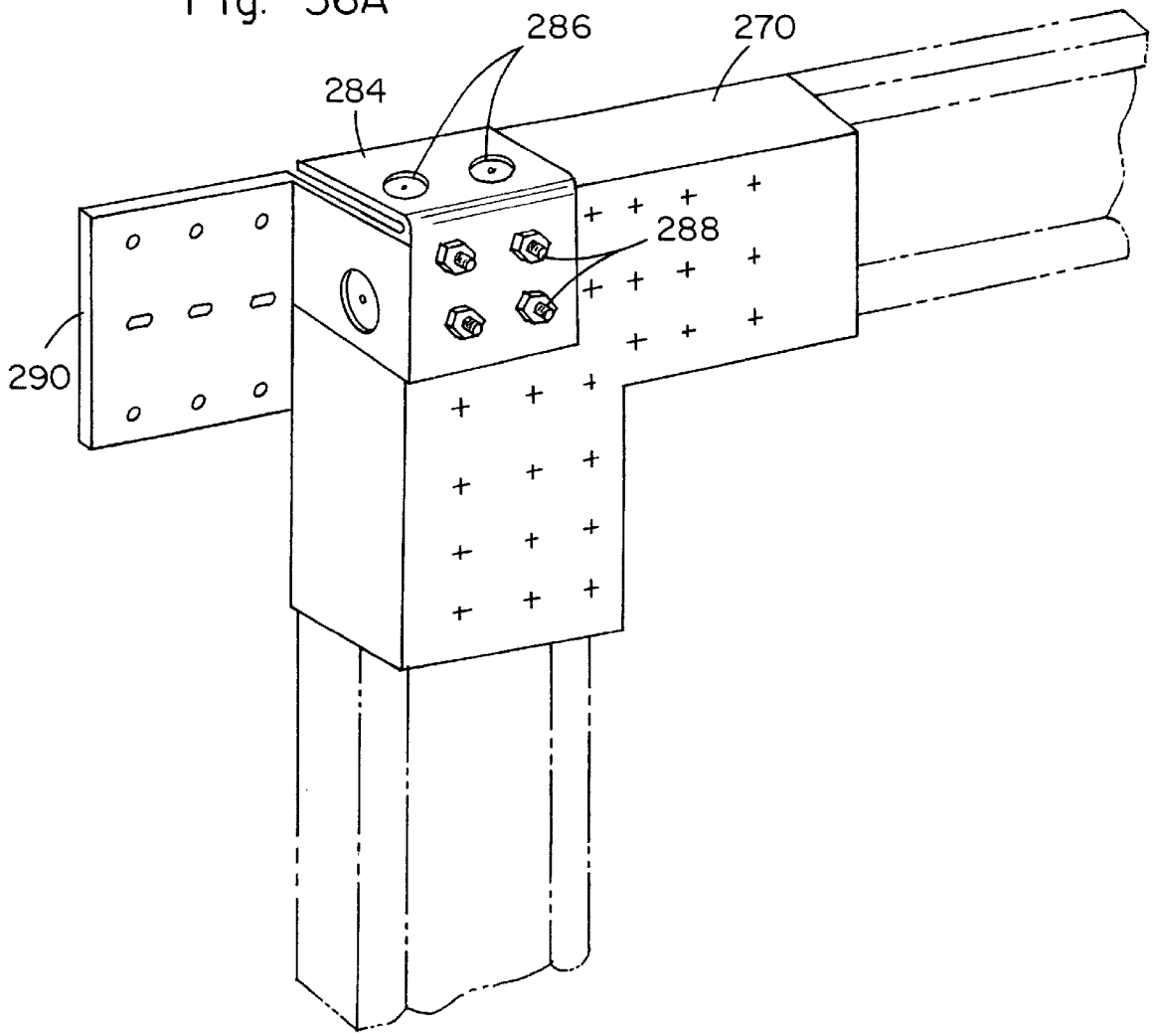
FIG. 36*a* is a perspective view showing a corner attachment for the base plate of this invention adapted for relatively heavy loads such as traverse rods, valance or swags using reverse bolts for attachment.
Figure 36B:
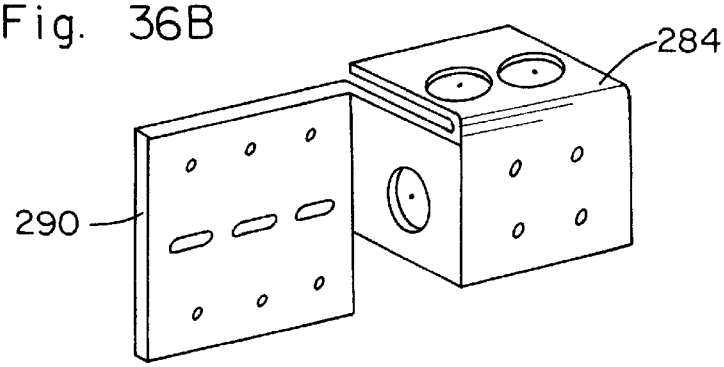
FIG. 36*b* is a corner angle attachment showing recessed tack holes similar to FIG. 36*a.*

In the event that the window hanging is relatively heavy and a heavy duty attachment is desired, in FIG. 36*a* and *b*, a corner attachment member 284 is provided. This member typically has tack wells 286 and may have a nut and bolt combination 288 to attach the member 284 to a corner base plate such as 270. This then leaves a flange 290 extending outwardly therefrom for mounting conventional window hangings.

Figure 37A:
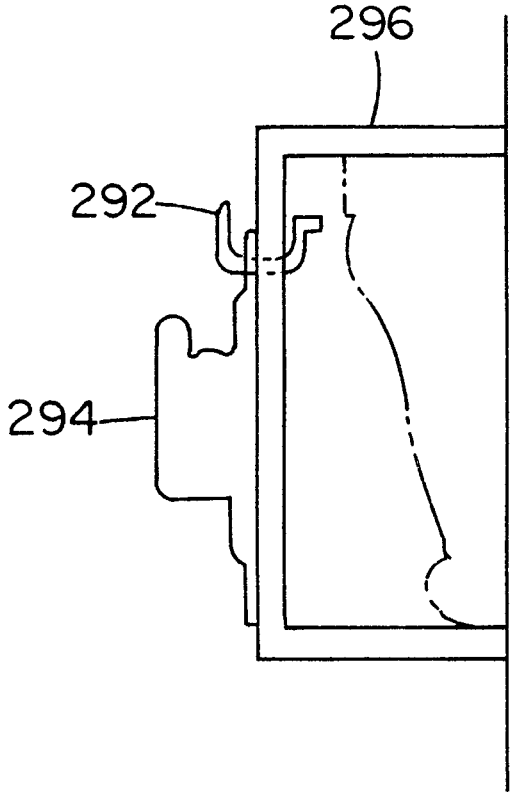
FIG. 37*a* is a cross-sectional view showing a hanging hook mount for a bracket of this invention on a base plate.

In addition, with reference to FIGS. 37*a* and *b*, the nut and bolt combination such as shown in FIG. 34 can be replaced by a hook 292 to retain a conventional bracket 294 in the base plate 296 of this invention.

Figure 37B:
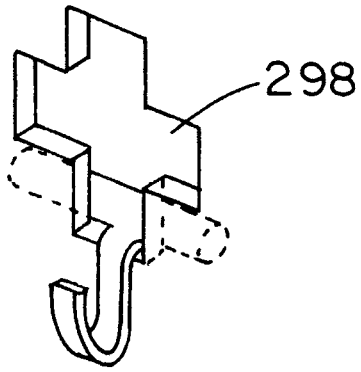
FIG. 37*b* is a perspective view of a hook mount useful in the embodiment of FIG. 37*a.*

With reference to FIG. 37*b*, the hook 298 can have other configurations as will be obvious to those skilled in the art.

Figure 38A:
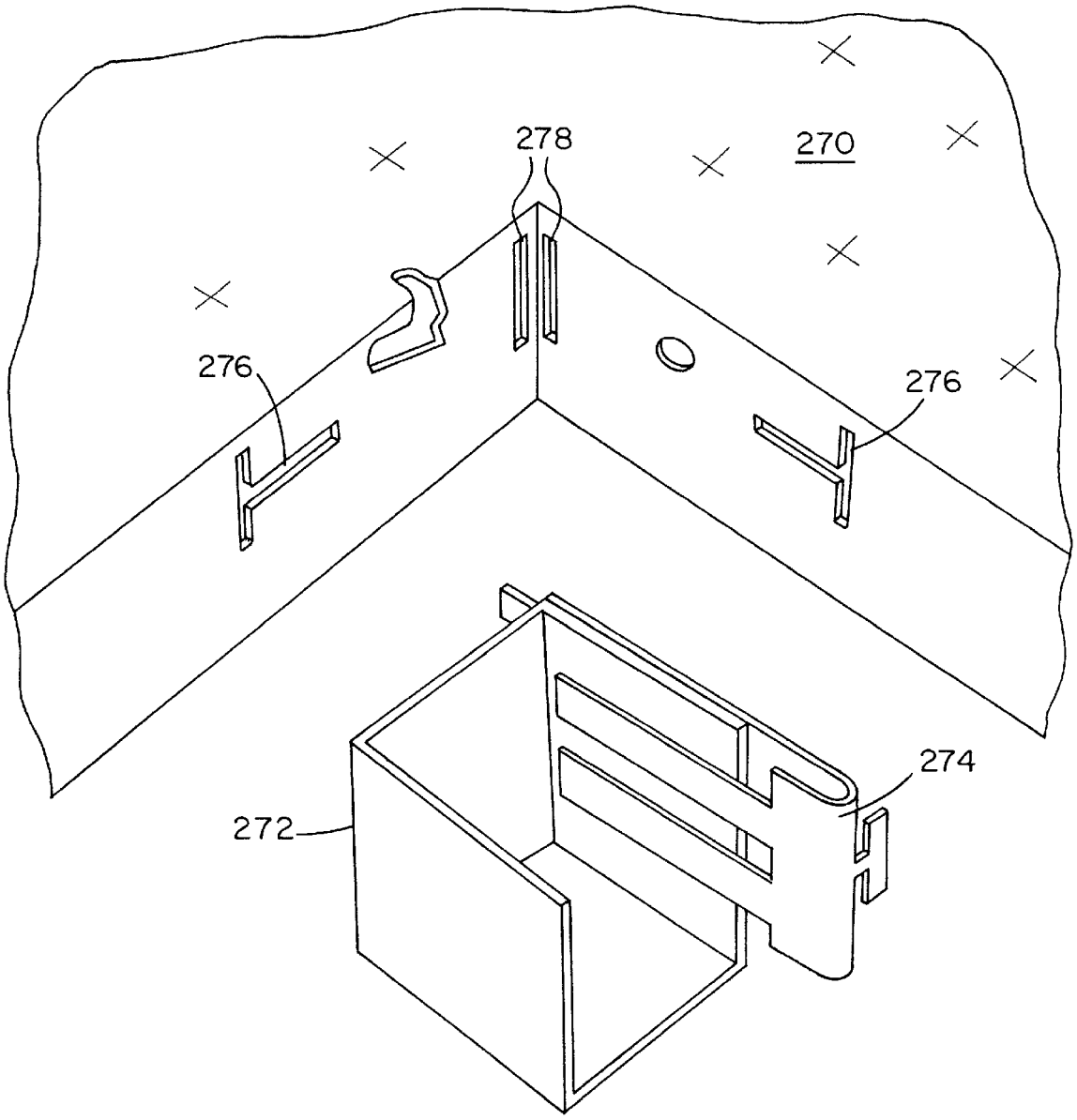
FIG. 38*a* is an exploded view of a preferred embodiment of this invention using a single clip for mounting a retaining box for mini-blinds.
Figure 38B:
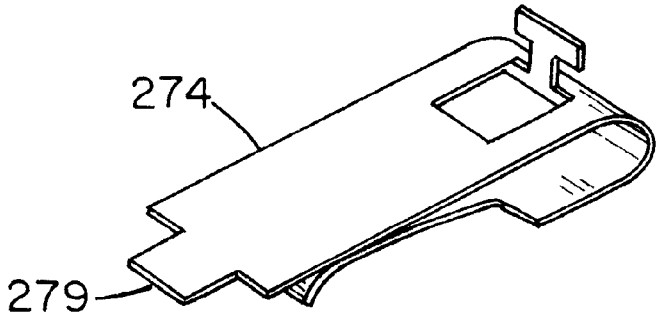
FIG. 38*b* is top perspective view of the clip of FIG. 38*a;*
Figure 38C:
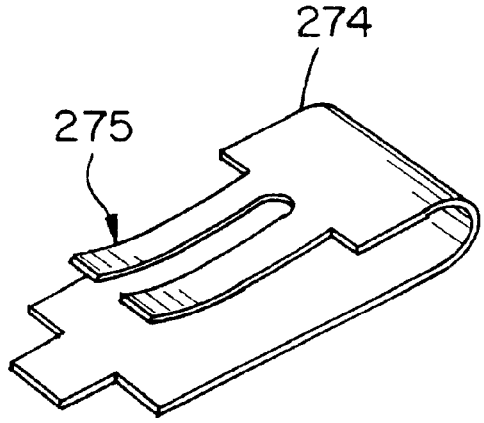
FIG. 38*c* is a perspective bottom view of the clip of FIG. 38*a.*
Figure 38D:
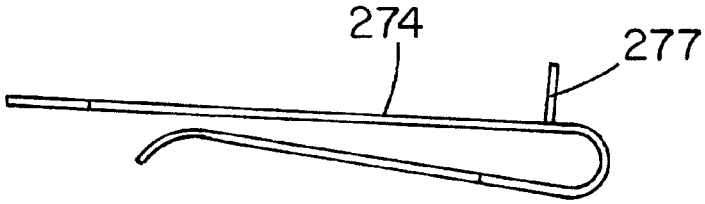
FIG. 38*d* is a side view of the clip.

Mini-blinds typically have ends resting in boxes disposed at either side of the window at the upper corners. In a preferred embodiment of this invention shown in FIGS. 38*a* and 38*b*, a box 272 is mounted by a single clip 274 on the base plate 270. The clip 274 has an upstanding T-shaped member 277 and a tab member 279 extending therefrom. These two members are intended to be inserted in slots 276 and 278 in the base plate 270. The box 272 is then retained by the spring members 275 in the clip 274.

Figure 39A:
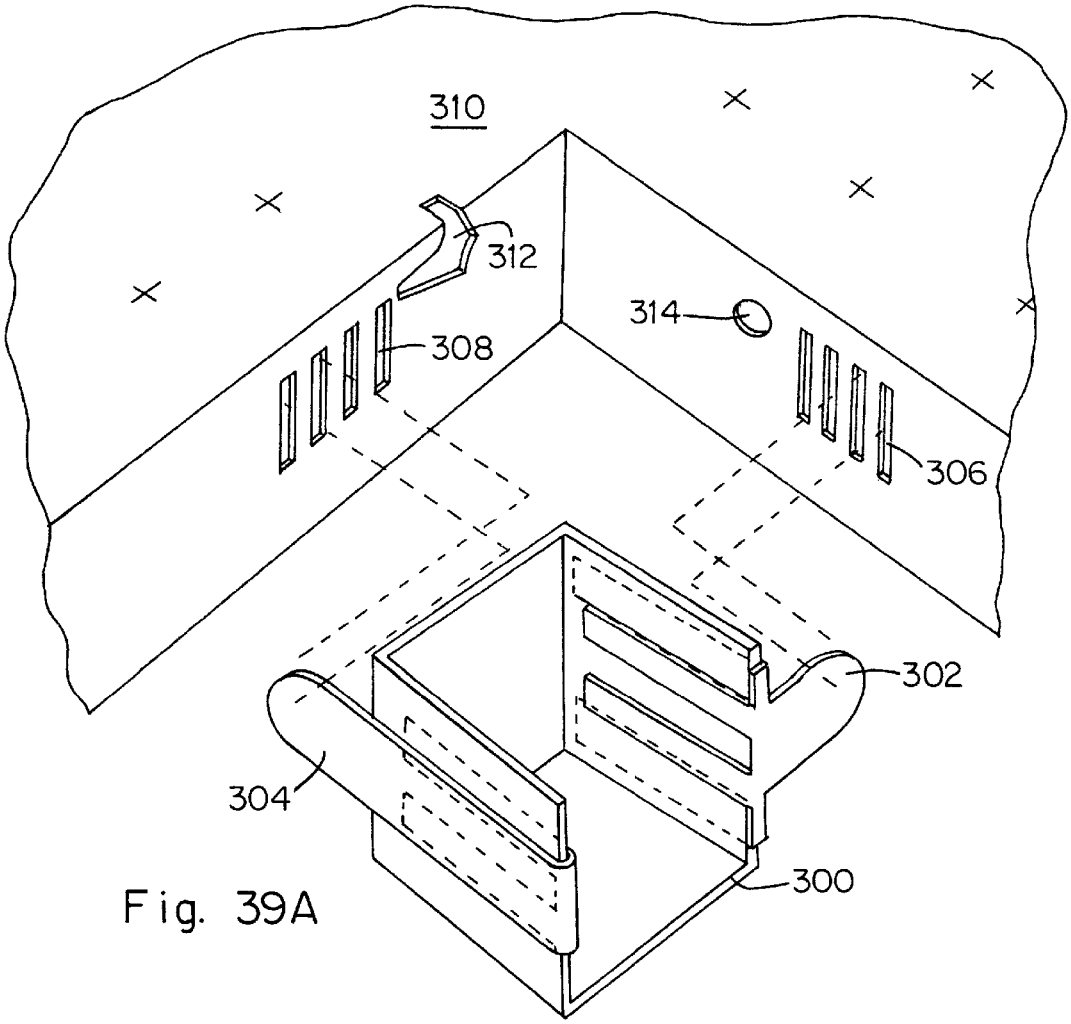
FIG. 39*a* is a perspective view showing a box mount for a mini-blind assembled on a base plate of this invention using the two clip design.

This preferred embodiment utilizes a single clip member 274 to retain the corner box 272. As will be described, in another embodiment a pair of clips can be provided. In FIG. 39*a*, a box 300 is held by top and bottom clips 302 and 304 and corresponding slots 306 and 308 are provided in the corner base plate 310. As shown, the base plate can have a slot 312 or a mounting hole 314 as previously described.

Figure 39B:
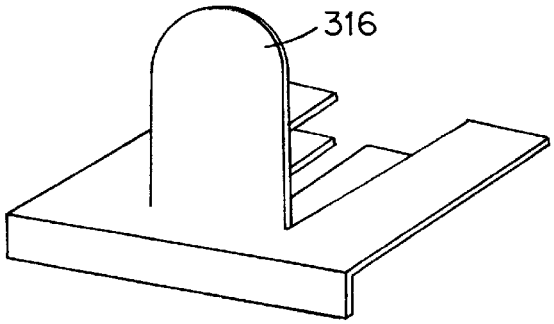
FIG. 39*b* is an isolated perspective view of the top clip of 39*a* itself.
Figure 39C:
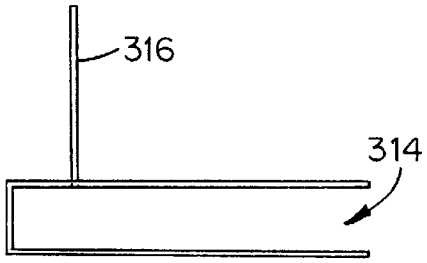
FIG. 39*c* is a perspective side view of the retention clip for the box of FIG. 39*a;*

With reference to FIG. 39*b*, the top clip typically has a U-shaped bracket 314 which is intended to be received in a side of the box 300 as shown in FIG. 39*a*, and an upstanding tab 316 to be received in one of the slots 306.

Figure 39D:
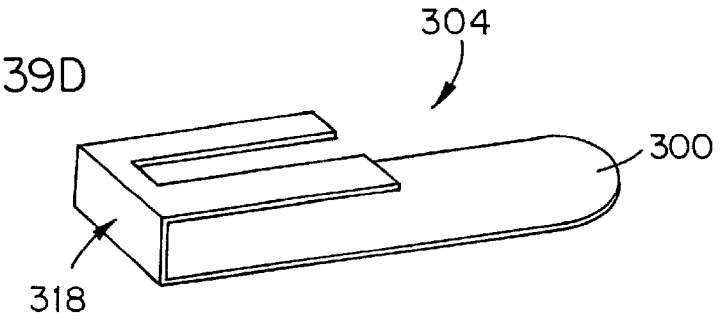
FIG. 39*d* is a perspective view of the lower clip for retention of the mini-blind box by the two clip design of FIG. 39*a;*
Figure 39E:
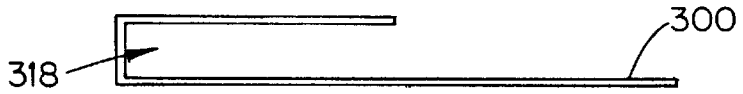
FIG. 39*e* is a side view of the lower clip of FIG. 39*d;*

With reference to FIG. 39*d* and *e*, the bottom clip 304 similarly has a U-shaped portion 318 to receive a side of the box 300 and a tab member 320 for insertion into a corresponding slot 308.

Figure 40A:
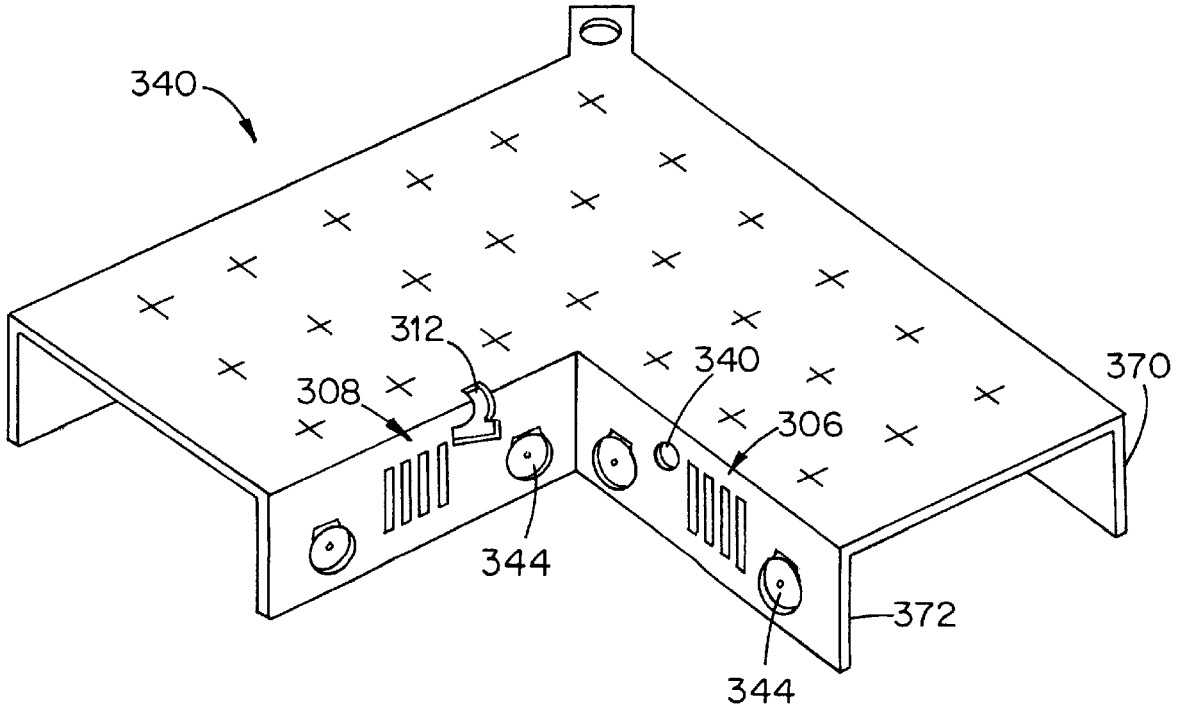
FIG. 40*a* is a corner base plate according to this invention having slots, tack wells and cut-outs for receiving shades on the inside flanges thereof according to the embodiment of FIG. 39*a;*
Figure 40B:
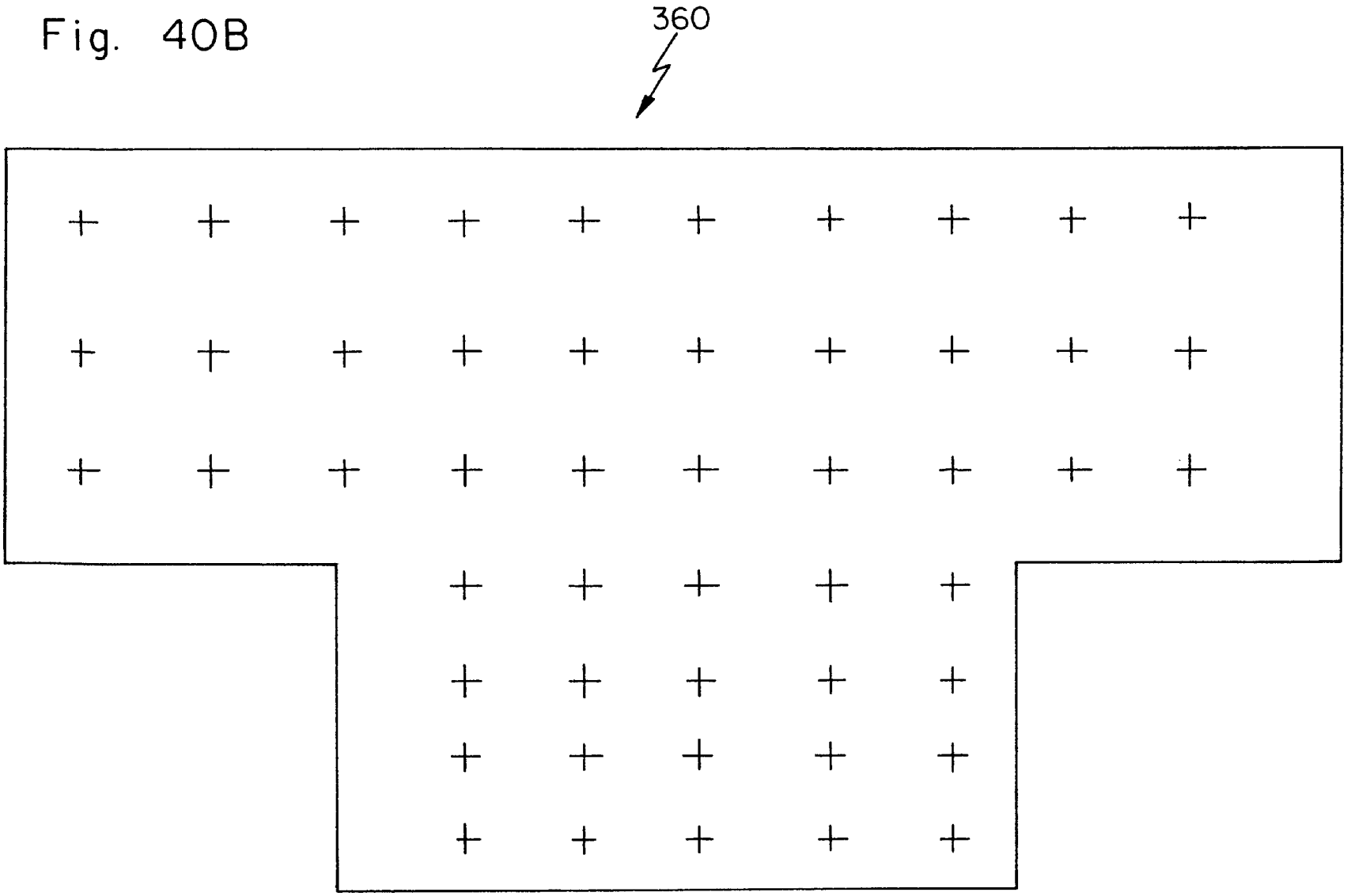
FIG. 40*b* is a base plate for a mid-run of a double window according to this invention.

As shown in FIG. 40*a* and 40*b*, then a universal corner base plate 340 or 340' would have slots 342 or mounting holes 343 for roll-up shades and slots 306 and 308 for tabs for mounting a mini-blind retaining box respectively with one or two clips. In addition, tack wells 344 would be provided for mounting the same to a molding (not shown). Furthermore, the base plate 360 as shown in FIG. 40*b* need not be L-shaped but can be provided with a stabilizing arm on either side if it is intended to be the base plate for a mid-run of a double window.

Figure 41A:
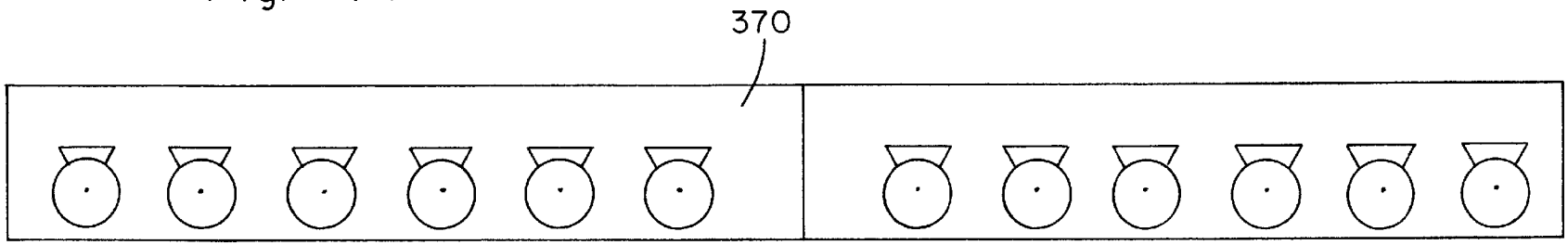
FIG. 41*a* is a front view of corner base plate flanges illustrating tack wells from the outside.
Figure 41B:
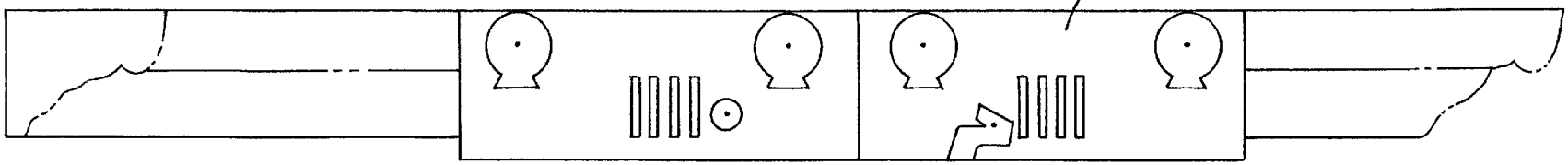
FIG. 41*b* is a view similar to FIG. 41*a* illustrating the inside flanges.

FIG. 41*a* then illustrates the outer flange 370 of the corner base plate 340, and FIG. 41*b* illustrates the inner flange 372 of the same type of base plate as shown in FIG. 40*a*. As will be obvious to those skilled in the art, the number of slots, tack wells, and the like is a design choice.

Figure 42A:
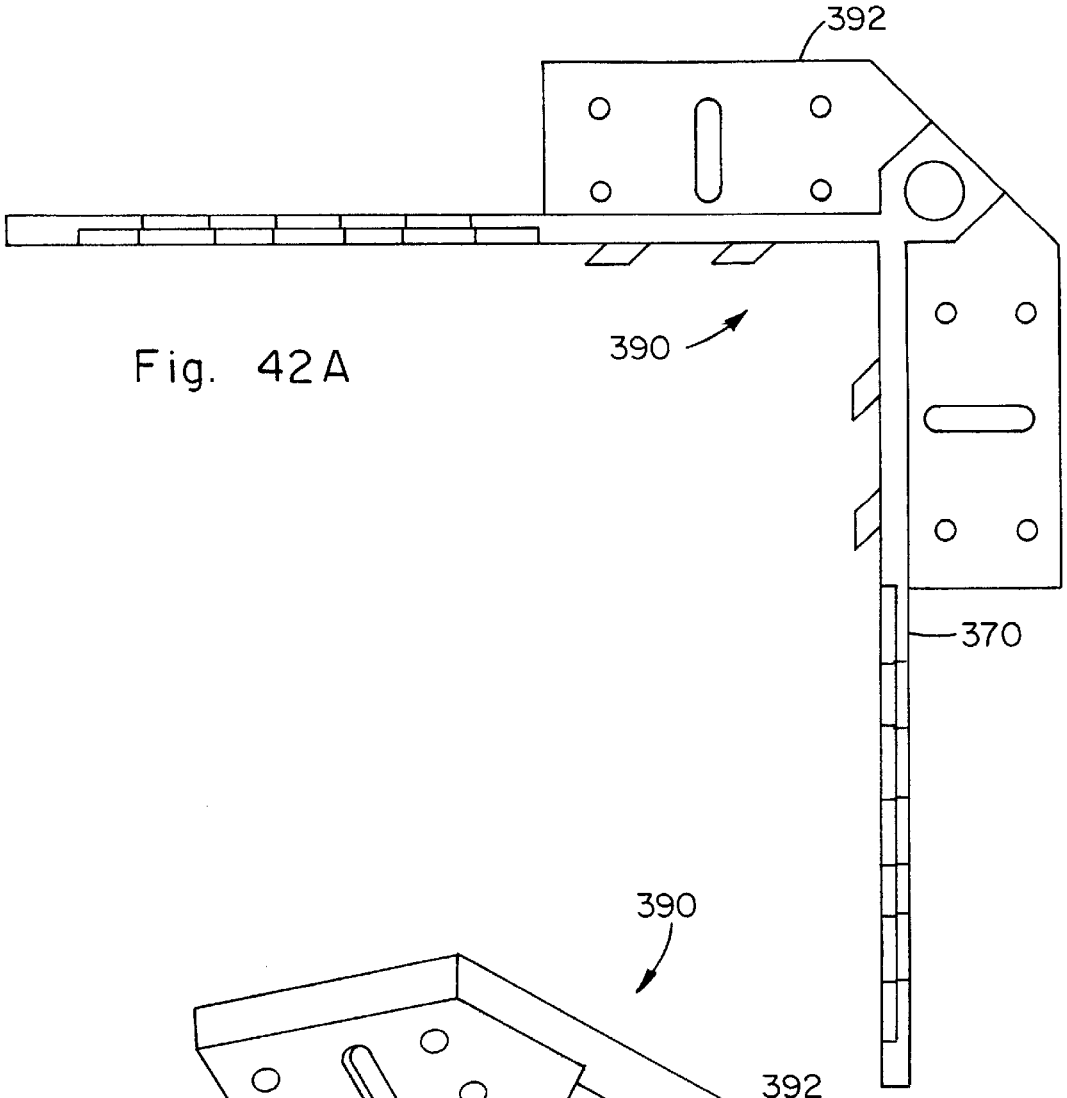
FIG. 42*a* is a side view of a traverse rod/swag bracket according to this invention.
Figure 42B:
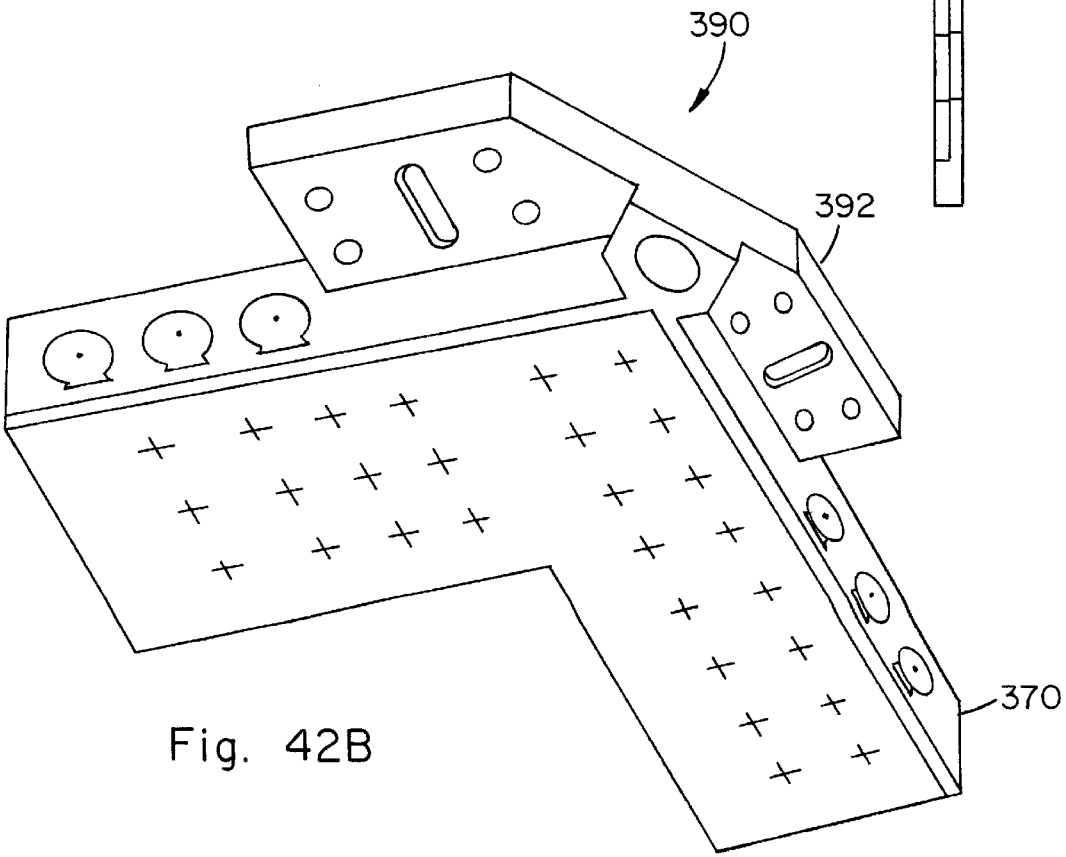
FIG. 42*b* is a perspective view of the embodiment of FIG. 42*a.*

FIGS. 42*a* and *b* illustrate another embodiment 390 of the corner bracket base plate of this invention designed for traverse rods, swag and the like. In this embodiment a flange 392 extends outwardly from the outer portion 370. Various slots and holes are provided in the flange 392 for mounting the hardware described in this invention.

Figure 43A:
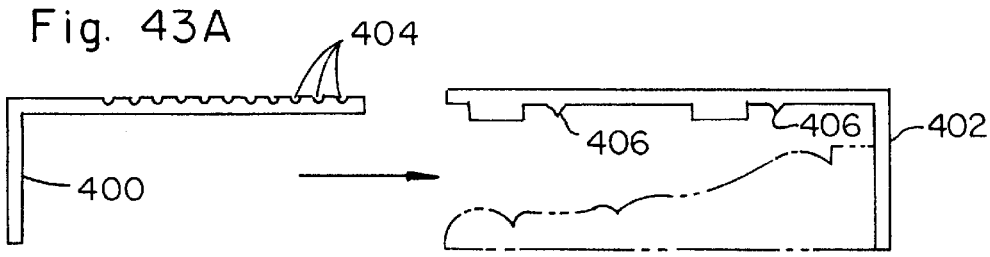
FIG. 43*a* is an exploded view of a base plate of this invention utilizing ratchet action depressions for assembly.
Figure 43B:
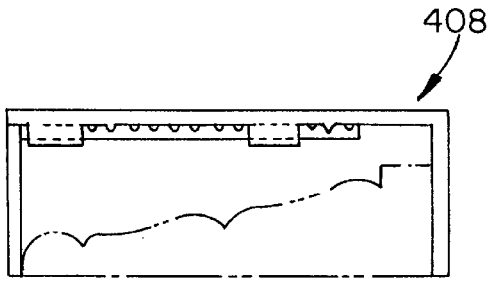
FIG. 43*b* is an assembled view of the embodiment of FIG. 43*a.*

In a further embodiment of FIGS. 43*a* and *b*, the base plate may consist of two L-shaped arms 400 and 402 which have grooves 404 which receive protrusions 406 so that when the plate is assembled as shown in FIG. 43*b* a ratcheting effect will be achieved in order to hold the assembled base plate 408 together. Conventional tacks or the like will be provided in the flanges as described in other embodiments of this invention but not shown here.

Figure 44A:
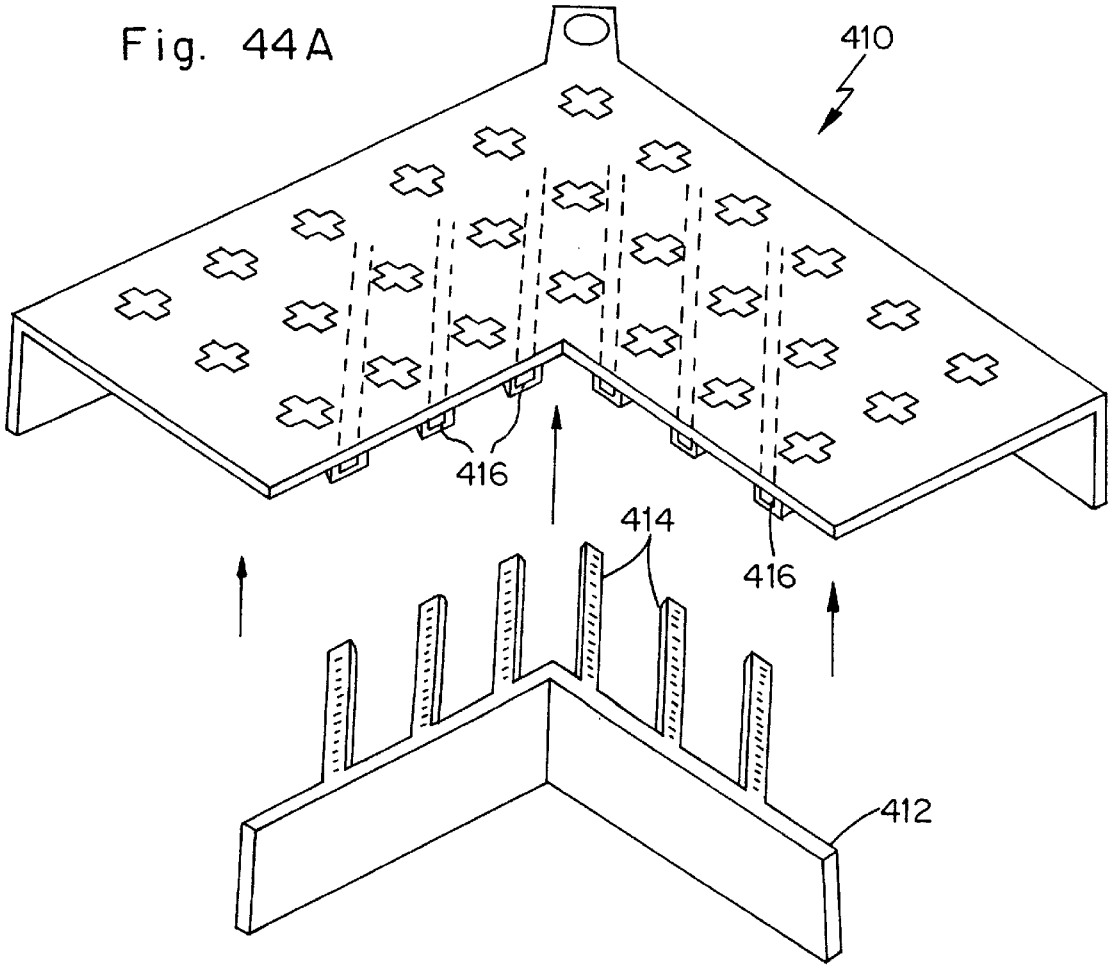
FIG. 44*a* is a exploded view of another embodiment of a corner base plate showing flanges adjustable for width.
Figure 44B:
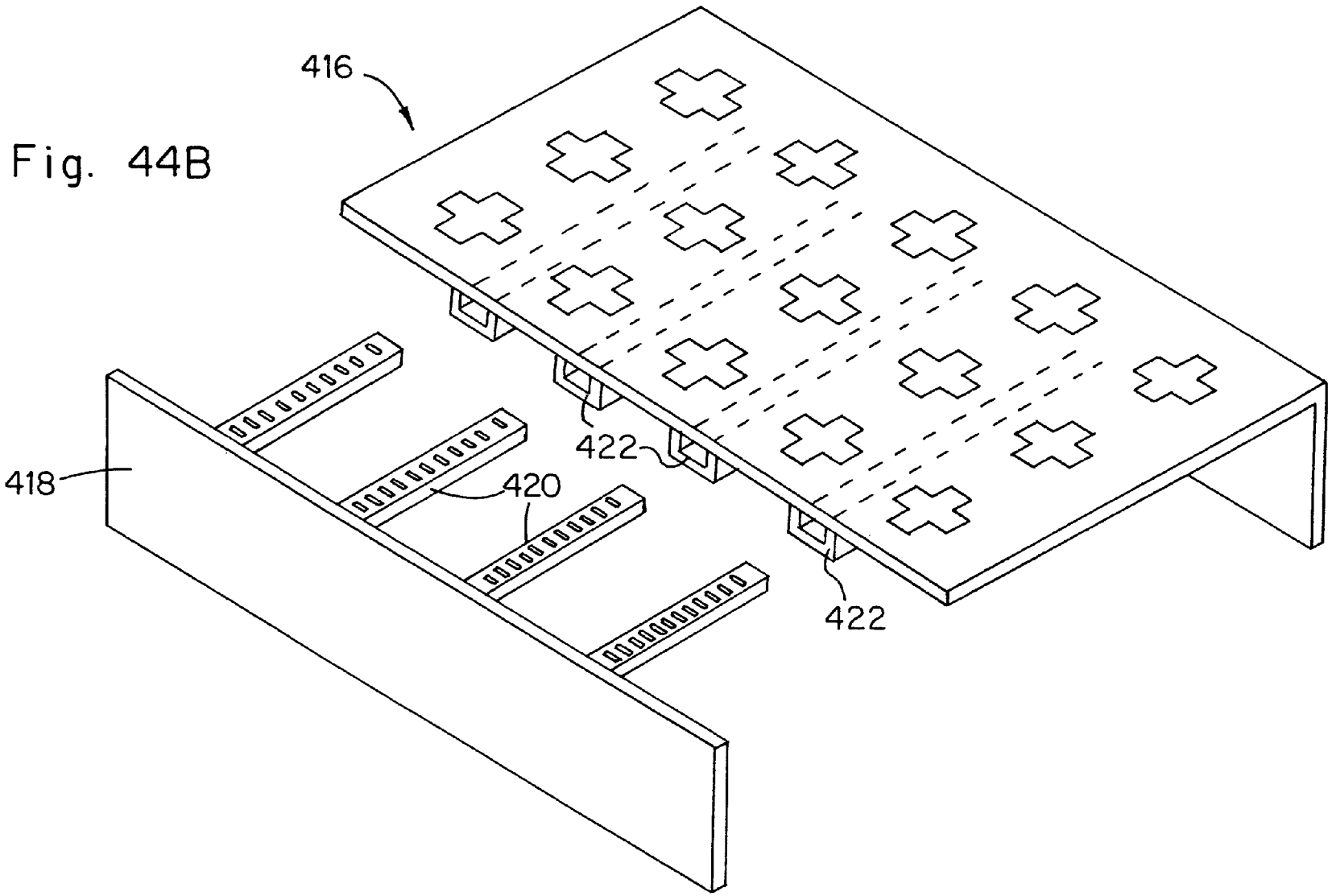
FIG. 44*b* is an embodiment similar to FIG. 44*a* showing a linear base plate with flanges adjustable for width.

In order to provide for width adjustment, in the embodiment of FIG. 44*a*, the corner base plate 410 has a separate inner flange 412 which mounts fingers 414 which in turn are slidably received in slots 416 so that the width of the overall base plate is adjustable. Similarly, in the embodiment of FIG. 44*b*, a linear base plate 416 can be provided wherein the inner flange 418 also mounts fingers 420 which are slidably received in slots 422 to assemble the linear base plate.

Figure 45A:
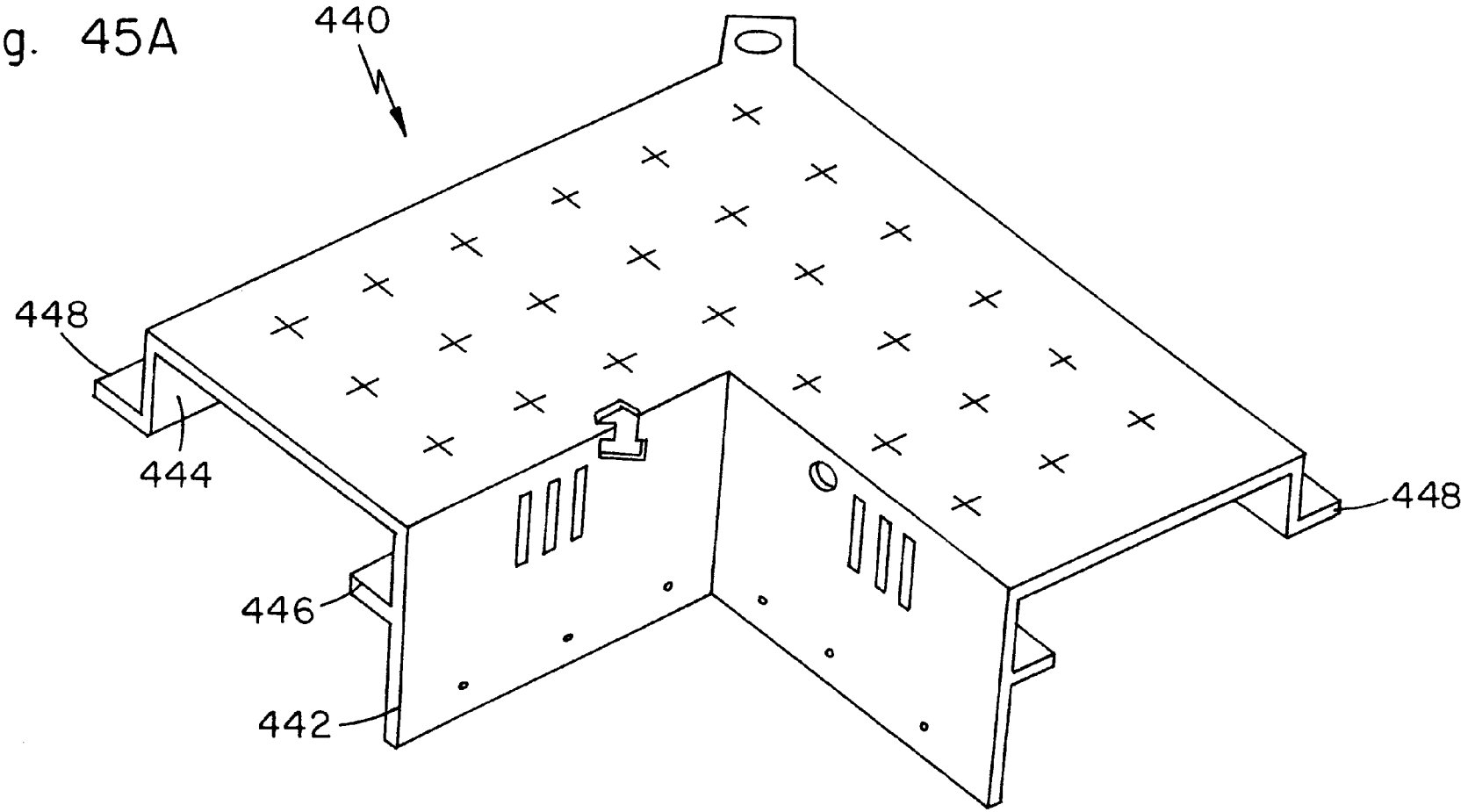
FIG. 45*a* is a corner plate for a "butt" finished corner with no molding.
Figure 45B:
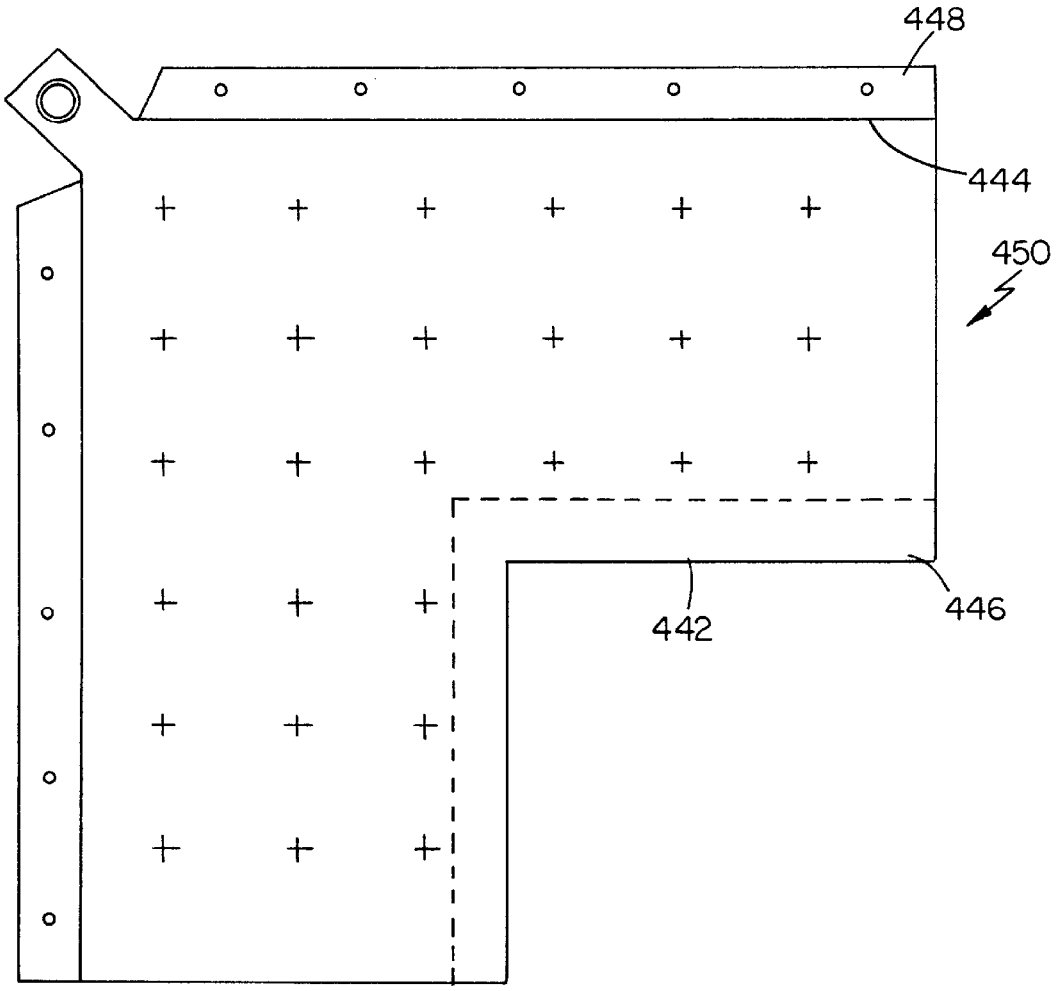
FIG. 45*b* is a top view of the embodiment of FIG. 45*a*.
Figure 45C:
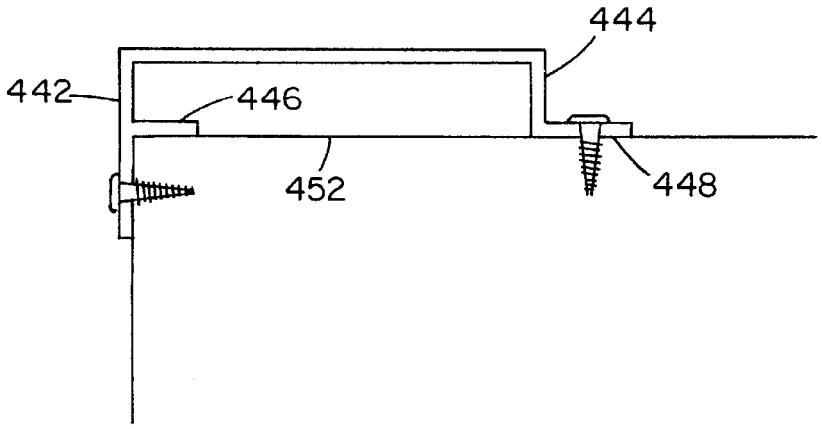
FIG. 45*c* is an assembled view in cross-section of the embodiment of FIGS. 45*a* and *b* mounted on a "butt" corner.

In yet another embodiment of FIGS. 45*a–c*, designed for "butt" finished corner wherein there is not molding, the base plate 440 is provided with inner and outer flanges 442 and 444 which in turn mount shelves 446 and 448. As shown in FIG. 45*c*, the shelves are used both to stabilize and to mount the corner base plate 450 on the face or edge of a window 452 obviously this design could be adapted to a linear base plate also is desired.

In summary, a unique mounting device for window dressings is disclosed which permits orienting the window dressing quickly and suspending the same without a great deal of construction, pain staking measurement, or the like. In addition, the device of this invention permits mounting window dressings with conventional brackets without the necessity for drilling holes in the face of the molding so that the means for attachment to the molding is substantially unseen after the device of this invention is removed from the molding.

Typically, the device consists of linear and corner mounting plates which may releaseably secure a universal clip member as projections from the clip member are inserted into cut-outs in the mounting plate and the clip member positioned for the desired orientation. A plurality of mutually spaced cut-outs are provided so that the projections from the universal clip will register thereon no matter what the orientation of the clip is relative to the mounting plate. A conventional mounting bracket can then be slidably inserted in the clip and retained therein so that the window dressing is mounted on its conventional mounting bracket, or an interface plate can be provided which attaches to either or applicable hardware shutter, applicable hardware, or a mounting bracket and itself then is slidably received in the clip or directly plates.

It is not intended that this invention is limited to the dimensions as will be obvious to those skilled in the art. In addition, the material of construction is not intended to be limitative in that the device of this invention could obviously be fabricated from plastic, metal or a combination thereof. It is intended, however, to provide a material which can be painted as desired so that it is relatively hidden on the molding or window frame once the window dressing has been mounted thereon.

It will be readily seen by one of ordinary skill in the art that the present invention fulfills all of the objects set forth above. After reading the foregoing specification, one of ordinary skill in the art will be able to effect various changes, substitutions or equivalents and various other aspects of the invention as broadly disclosed herein. It is therefore intended that the protection granted hereon be limited only by the definition contained in the appended claims and equivalents thereof.

I claim:

1. In a device for mounting a window dressing in a window frame wherein the frame has an inner and an outer surface disposed perpendicular to a window and a face disposed perpendicular to the inner and outer surfaces, the improvement comprising:

a tension rod adapted to support the window dressing, said tension rod having opposing ends with feet thereon which are normally biased axially outwardly;

a pair of L-shaped mounting brackets for mounting said tension rod on the window frame, each bracket having a first leg adapted to be mounted on the frame and a second leg defining a bearing surface disposed in a plane perpendicular to said first leg; retaining means carried by said second leg for retaining a foot of said rod against said bearing surface of said bracket and mounting means carried by said bracket for affixing said bracket to said frame;

each first leg having a face wall and at least one side wall disposed perpendicular thereto, said face and said side wall adapted to abut the inner surface and face of the frame, said mounting means being carried by one of said legs.

2. The device of claim 1 wherein each first leg is is adapted to extend across at least a part of the face of said frame and said side wall is adapted to extend over an adjacent surface of said frame.

3. The device of claim 1 wherein said first leg has an inner surface with a predetermined surface configuration.

4. The device of claim 1 wherein said retaining means includes an inwardly extending lip on said second leg, said lip being distal to said first leg.

5. The device of claim 1 wherein said retaining means includes an indentation dimensioned to receive a foot of said tension rod disposed on a portion of said second leg adjacent the window.

6. The device of claim 5 wherein said retaining means further comprises a hole extending parallel to said bearing surface.

7. The device of claim 1 wherein said mounting means includes a tack extending through said first leg.

8. The device of claim 1 wherein said mounting means includes a tack extending through a side wall of said second leg.

9. The device of claim 1 wherein said second leg has at least an upper surface extending therealong outwardly from said first leg and said surface defines a cut out portion adapted to receive a portion of a curtain rod therein.

10. The device of claim 1 wherein said first leg has a pair of mutually spaced side walls, extending from said face wall, said side walls and face wall forming in cross-section a substantially U-shaped said first leg.

11. The device of claim 1 wherein said mounting means includes a recess in one of said legs and a centrally located hole therethrough.

12. The device of claim 11 wherein said mounting means further comprises a tack adapted to extend through said hole in said first leg with a head portion of said tack received in said recess.

13. The device of claim 11 wherein said recess includes an access ramp at a side portion thereof.

14. The device of claim 1 wherein said retaining means includes a semicircular groove on a distal portion of said second leg adapted to cradle an end of a curtain rod.

* * * * *